US010194762B2

(12) United States Patent
Isaacs

(10) Patent No.: US 10,194,762 B2
(45) Date of Patent: Feb. 5, 2019

(54) CORNERLOCK FOR A FRAME ASSEMBLY INCLUDING A COLLAR

(71) Applicant: Quanex Homeshield LLC, Mounds View, MN (US)

(72) Inventor: Joseph D. Isaacs, Cameron, WI (US)

(73) Assignee: Quanex Homeshield LLC, Mounds View, MN (US)

( * ) Notice: Subject to any disclaimer, the term of this patent is extended or adjusted under 35 U.S.C. 154(b) by 0 days.

(21) Appl. No.: 15/460,751

(22) Filed: Mar. 16, 2017

(65) Prior Publication Data

US 2017/0265661 A1 Sep. 21, 2017

Related U.S. Application Data

(60) Provisional application No. 62/309,203, filed on Mar. 16, 2016.

(51) Int. Cl.

| | |
|---|---|
| ***A47G 5/04*** | (2006.01) |
| ***E06B 9/52*** | (2006.01) |
| ***E06B 3/964*** | (2006.01) |

(52) U.S. Cl.

CPC ..... *A47G 5/04* (2013.01); *E06B 3/964* (2013.01); *E06B 9/52* (2013.01)

(58) Field of Classification Search

CPC ..... E06B 3/16; E06B 3/9646; E06B 3/9616; E06B 3/9682; E06B 3/9725; E06B 3/964; E06B 9/52; A47G 5/04

See application file for complete search history.

(56) References Cited

U.S. PATENT DOCUMENTS 3,317,227 A * 5/1967 Nijhuis ..... E06B 3/9644 403/231
4,105,348 A * 8/1978 Anderson ..... F16B 7/0446 211/182

(Continued)

FOREIGN PATENT DOCUMENTS

AT 384463 B 11/1987
CN 201406942 Y 2/2010

(Continued)

OTHER PUBLICATIONS

English language abstract and machine-assisted English translation for AT 384463 extracted from espacenet.com database on Mar. 23, 2017, 5 pages.

(Continued)

*Primary Examiner* — Brian D Mattei
(74) *Attorney, Agent, or Firm* — Howard & Howard Attorneys PLLC

(57) ABSTRACT

A cornerlock is used with a frame assembly which includes first and second frame members each having a plurality of walls extending between first and second ends. Each of the first and second frame members define an interior with the cornerlock extending into the interiors. An article is coupled to the first and second frame members. The cornerlock includes a first body member configured to mate with the interior of the first frame member and a second body member configured to mate with the interior of the second frame member. Each of the body members has a hinge end and are rotatably coupled together at the hinge ends. A collar defines a hole with at least one of the first and second body members extending through the hole such that the collar is disposed substantially at the hinge end for engaging each of the first and second frame members.

17 Claims, 14 Drawing Sheets

(56) References Cited

U.S. PATENT DOCUMENTS

| | | | | |
|---|---|---|---|---|
| 5,028,165 | A | 7/1991 | Schools | |
| 5,048,997 | A * | 9/1991 | Peterson | E06B 3/667 403/295 |
| 5,154,034 | A * | 10/1992 | Stanek | E06B 3/685 403/84 |
| 5,517,794 | A * | 5/1996 | Wagner | E04F 19/02 403/110 |
| 8,028,489 | B1 | 10/2011 | Lawrence | |
| 8,250,819 | B2 | 8/2012 | Subra | |
| 8,490,347 | B2 | 7/2013 | Valler et al. | |
| 8,528,293 | B2 | 9/2013 | Sawyers et al. | |
| 2008/0072517 | A1* | 3/2008 | Grazioso | E06B 3/9646 52/698 |
| 2008/0256895 | A1 | 10/2008 | Niswonger | |
| 2012/0279166 | A1* | 11/2012 | Valler | E06B 3/16 52/656.2 |
| 2016/0340970 | A1* | 11/2016 | Mitchell | E06B 7/2305 |
| 2017/0218680 | A1* | 8/2017 | Isaacs | E06B 1/12 |

FOREIGN PATENT DOCUMENTS

| | | | |
|---|---|---|---|
| CN | 201695899 | U | 1/2011 |
| CN | 201826708 | U | 5/2011 |
| CN | 201902131 | U | 7/2011 |
| DE | 10 2006 005 378 | A1 | 9/2006 |
| DE | 20 2011 050 843 | U1 | 10/2012 |
| EP | 2 105 571 | A2 | 9/2009 |
| GB | 2 476 264 | A | 6/2011 |
| GB | 2 476 484 | A | 6/2011 |
| NZ | 577734 | A | 9/2011 |
| WO | WO 2014/102558 | A1 | 7/2014 |

OTHER PUBLICATIONS

English language abstract and machine-assisted English translation for CN 201406942 extracted from espacenet.com database on Mar. 23, 2017, 5 pages.

English language abstract and machine-assisted English translation for CN 201695899 extracted from espacenet.com database on Mar. 23, 2017, 5 pages.

English language abstract and machine-assisted English translation for CN 201826708 extracted from espacenet.com database on Mar. 23, 2017, 6 pages.

English language abstract and machine-assisted English translation for CN 201902131 extracted from espacenet.com database on Mar. 23, 2017, 6 pages.

English language abstract and machine-assisted English translation for DE 10 2006 005 378 extracted from espacenet.com database on Mar. 23, 2017, 11 pages.

English language abstract and machine-assisted English translation for DE 20 2011 050 843 extracted from espacenet.com database on Mar. 23, 2017, 19 pages.

English language abstract for WO 2014/102558 extracted from espacenet.com database on Mar. 23, 2017, 2 pages.

* cited by examiner

FIG. 14
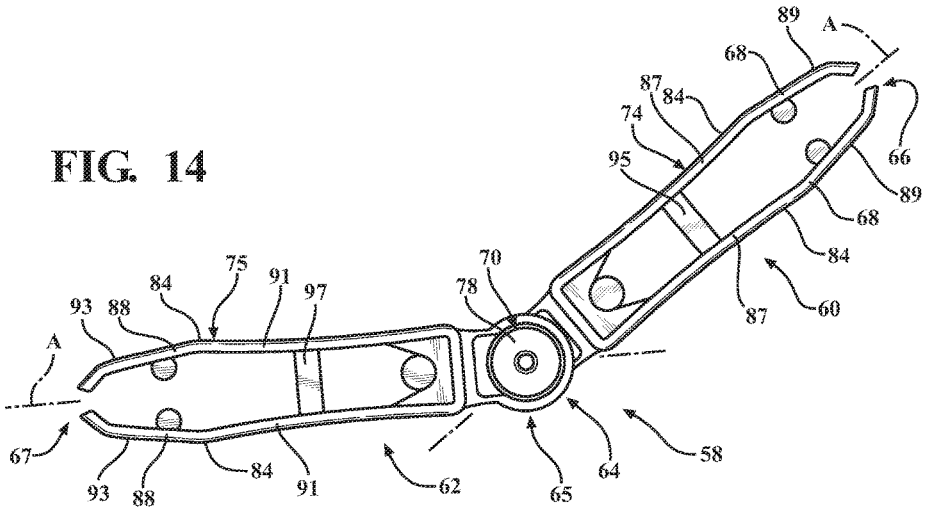
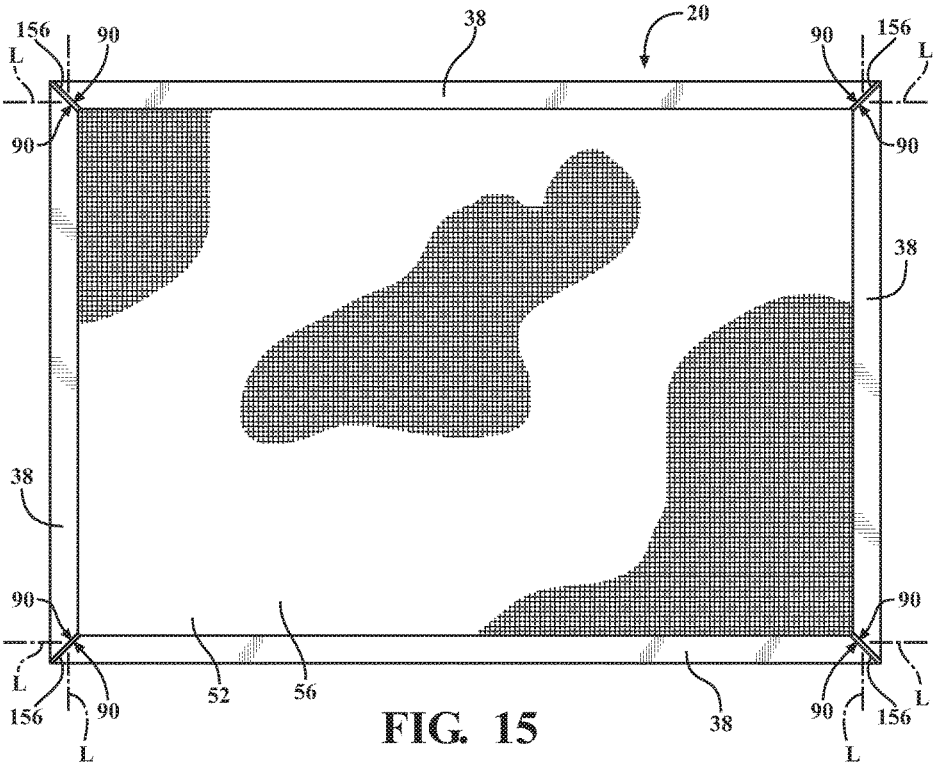
FIG. 15

FIG. 18
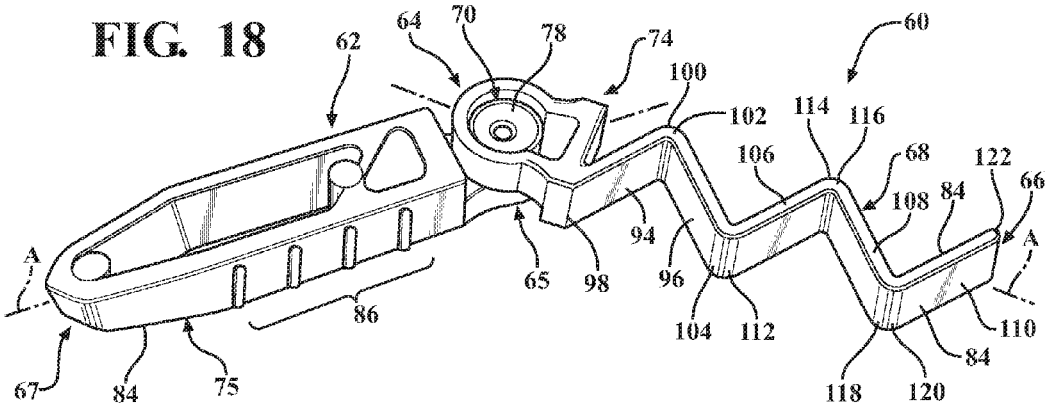
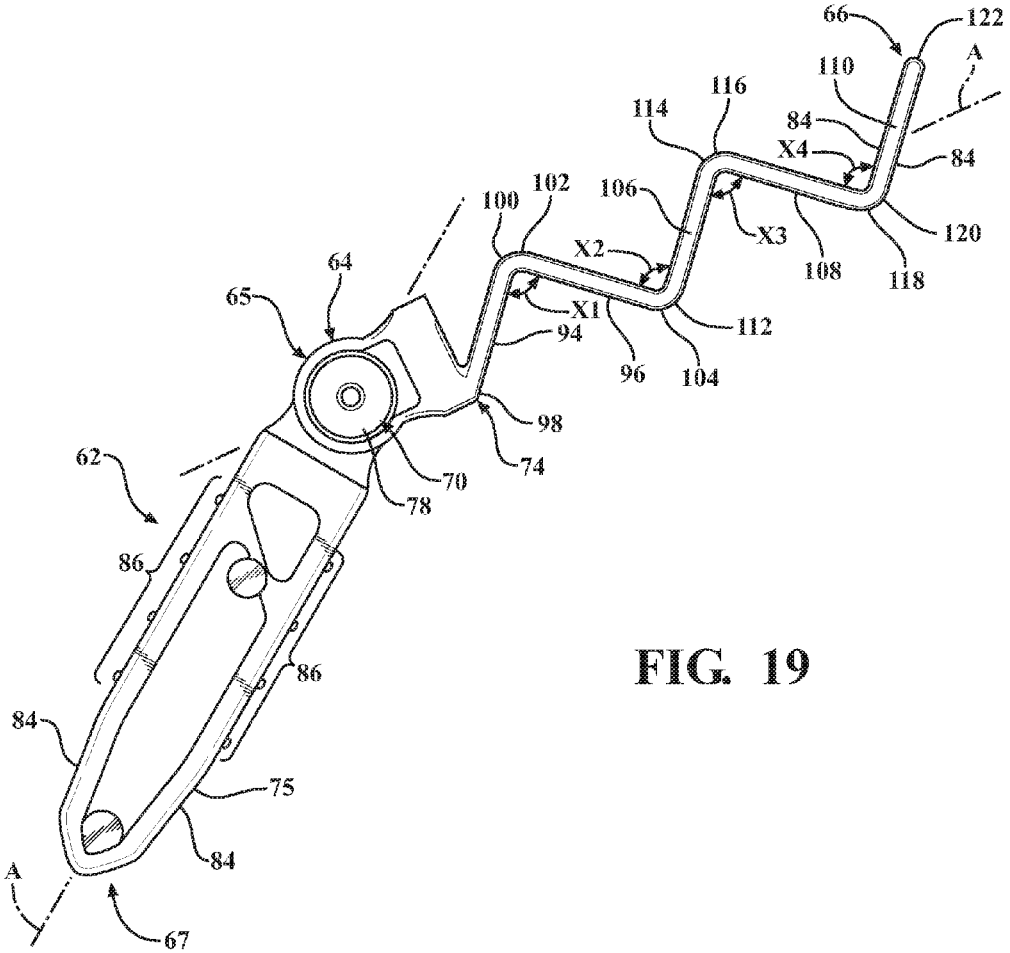
FIG. 19

CORNERLOCK FOR A FRAME ASSEMBLY INCLUDING A COLLAR

BACKGROUND OF THE INVENTION

1. Field of the Invention

The subject invention relates to a cornerlock for use with a frame assembly.

2. Description of Related Art

Cornerlocks are used with frame assemblies to couple together frame members of the frame assemblies. The frame assembly includes frame members each having first and second ends, with each defining an interior and a screen mounted to the frame members. Certain cornerlocks include locking members coupled to one another. One of the locking members is inserted into the interior of one of the frame members. Another one of the locking members is inserted into the interior of another one of the frame members. The locking members frictionally engage the frame members. The frame members are cut and abut one another, fully enclosing the cornerlock. The frame members may be painted before cutting, with the cut ends exposing bare metal that is visible at the abutment of the frame members. Furthermore, the cut ends of the frame members often have burrs from the cutting process that are exposed at the abutment of the frame members. As such, there remains a need to provide an improved cornerlock.

SUMMARY OF THE INVENTION AND ADVANTAGES

The subject invention provides for a cornerlock for use with a frame assembly. The frame assembly includes a first frame member and a second frame member each having a plurality of walls extending between a first end and a second end, which is spaced from the first end. Each of the first and second frame members define an interior, with the cornerlock extending into the interior of each of the first and second frame members.

The cornerlock comprises a first body member configured to mate with the interior of the first frame member and a second body member configured to mate with the interior of the second frame member. Each of the body members has a hinge end and a distal end spaced from the hinge end. The first and second body members are rotatably coupled together at the hinge ends.

The cornerlock further comprises a collar defining a hole. At least one of the first and second body members extends through the hole such that the collar is disposed at the hinge ends for engaging each of the first and second frame members.

Accordingly, the engagement of the first and second frame members with the collar prevents burrs and unpainted cut surfaces, formed during the cutting of the first and second ends of the frame members, from being exposed, which is aesthetically unappealing. Furthermore, the engagement of the first and second frame members with the collar prevents miter mismatch between the first and second frame members and helps to define a consistent overall size to the frame assembly.

BRIEF DESCRIPTION OF THE DRAWINGS

Advantages of the subject invention will be readily appreciated as the same becomes better understood by reference to the following detailed description when considered in connection with the accompanying drawings.

FIG. 14 is an elevational view of the first and second body members of the cornerlock with the first and second body members each having a pair of arms.

FIG. 15 is an elevational view of a frame assembly having frame members with each having a substantially linear configuration.

FIG. 18 is a perspective view of the first and second body members rotatably coupled together with the first body member having the at least one arm having a first section and a second section.

FIG. 19 is an elevational view of the first and second body members rotatably coupled together with the first body member having the at least one arm having the first section and the second section.

DETAILED DESCRIPTION OF THE INVENTION

Figure 1:
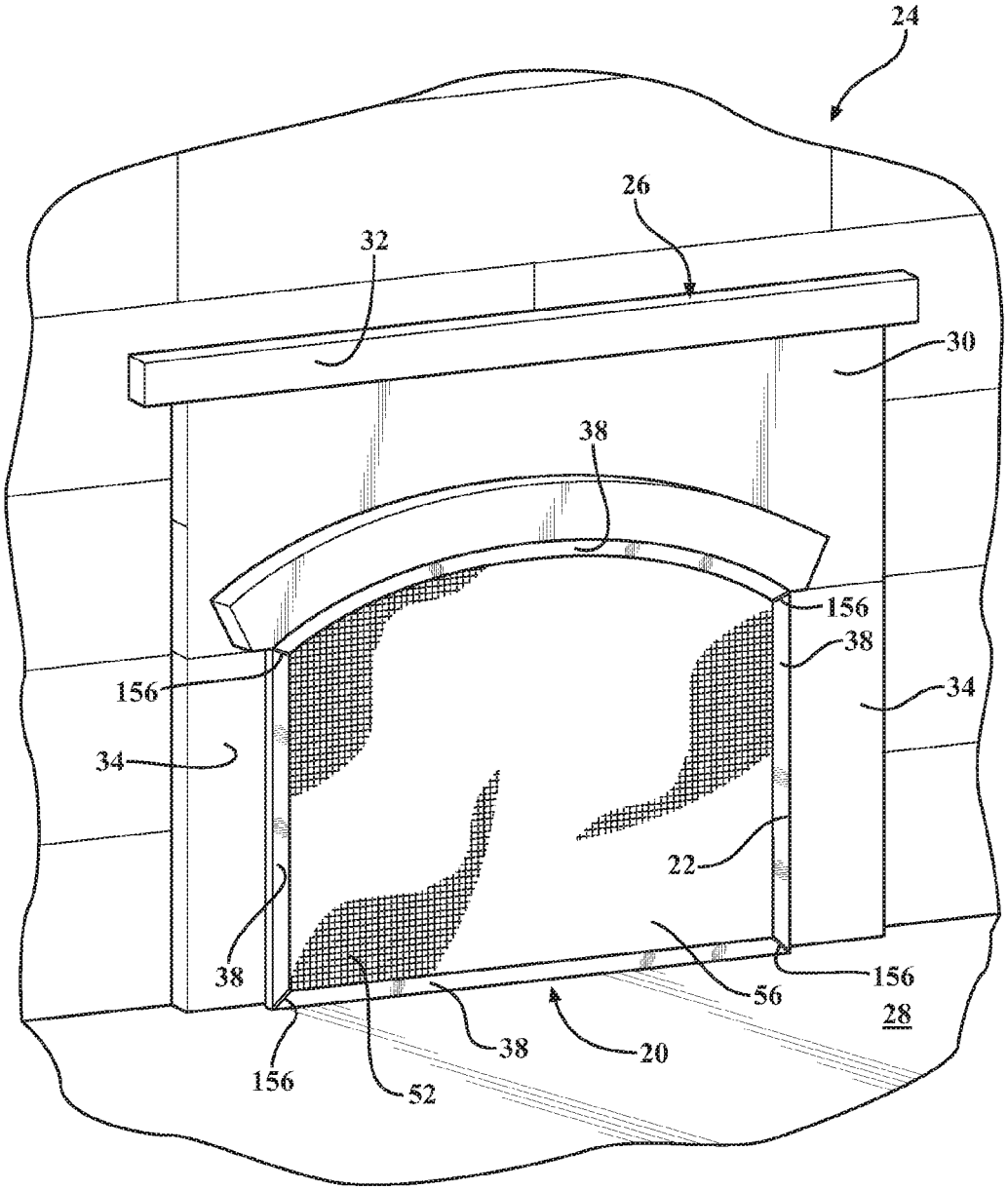
FIG. 1 is a perspective view of a frame assembly in an opening of a structure with the frame assembly showing frame members, a collar of a cornerlock, and an article.

Referring to the Figures, wherein like numerals indicates like or corresponding parts throughout the several views, a frame assembly 20 for disposing within an opening 22 of a structure 24 is generally shown in FIG. 1. The structure 24 is typically a fireplace 26, as shown in FIG. 1, which includes a hearth 28 and a header 30 spaced from and substantially parallel to the hearth 28 with both the hearth 28 and the header 30 extending horizontally in planes transverse to one another. The fireplace 26 further includes a mantel 32 mounted to the header 30 and a pair of legs 34 spaced from and substantially parallel to each other and vertically oriented between the hearth 28 and the header 30. The hearth 28, the header 30, and the pair of legs 34 define the opening 22. The fireplace 26 further includes a firebox positioned between the hearth 28 and the header 30 and between the pair of legs 34. Although not required, the fireplace 26 typically includes a flammable fuel within the firebox such as a timber log, a hydrocarbon gas, or an electric heater each of which emits heat. The fireplace 26 may include a glass panel positioned adjacent to the firebox for inhibiting direct entry into the firebox.

The structure 24 may be a building, such as a commercial or residential building, with the opening 22 providing access into the structure 24, such as a door opening or a window opening. It is to be appreciated that the structure 24 does not have to be the fireplace 26 and may be any structure 24 having the opening 22.

Figure 2:
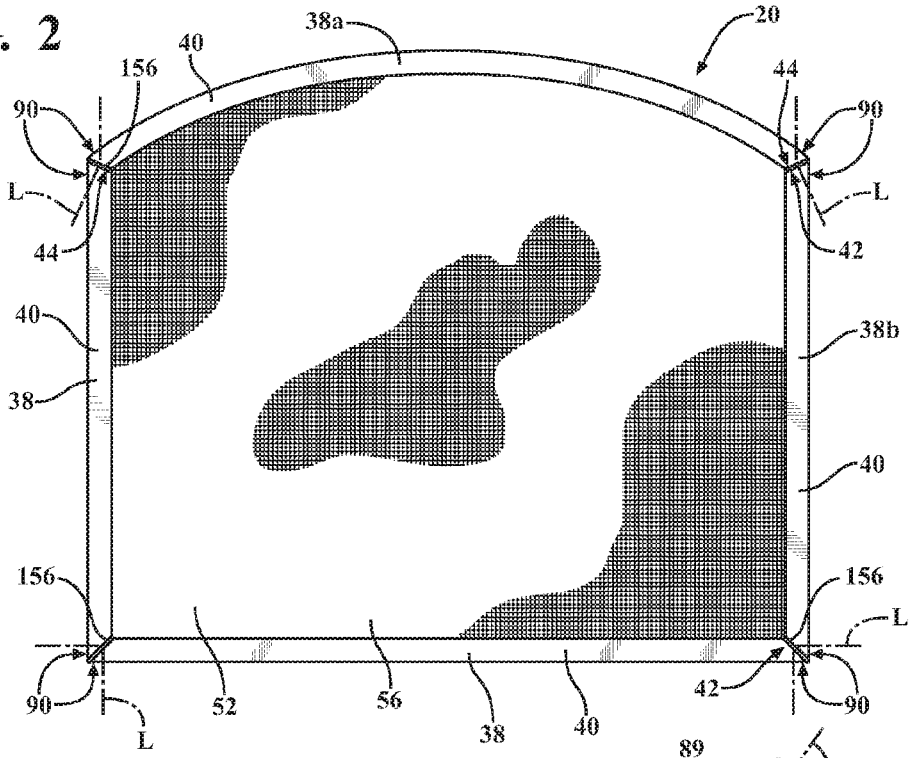
FIG. 2 is an elevational view of the frame assembly showing the frame members, the collar of the cornerlock, and the article.

The frame assembly 20 comprises a first frame member 38*a* and a second frame member 38*b*, as shown in FIG. 2. More specifically, the frame assembly 20 has at least two frame members 38, which include the first and second frame members 38*a*, 38*b*. Typically, the frame assembly 20 comprises more than two frame members 38 as shown in FIGS. 2 and 15. The first and second frame members 38*a*, 38*b* refer to two of the frame members 38, which are adjacent to one another. Said differently, the first and second frame members 38*a*, 38*b* may be any two of the frame members 38 that are adjacent to one another. For illustrative purposes, two of the frame members 38 shown in the FIGS. 2 and 6-9B have been selected to illustrate the first and second frame members 38*a*, 38*b*. It is to be appreciated that any of the frame members 38 shown in the Figures may be referred to as the first and second frame members 38*a*, 38*b*.

Figure 10:
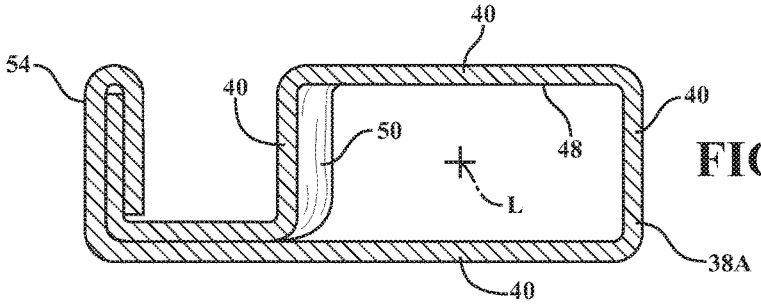
FIG. 10 is a cross-sectional view of the first frame member taken along 10-10 in FIG. 8 showing a cross-section of the first frame member.
Figure 11:
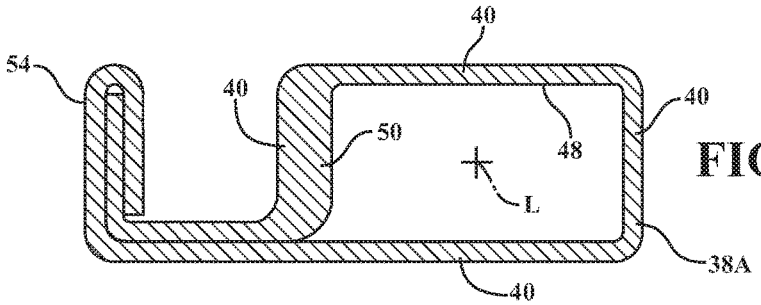
FIG. 11 is a cross-sectional view of the first frame member taken along 11-11 in FIG. 8 showing another cross-section of the first frame member.

As shown in FIG. 2, the first and second frame members 38*a*, 38*b* each have a plurality of walls 40 extending between a first end 42 and a second end 44, which is spaced from the first end 42. The first and second frame members 38*a*, 38*b* have a cross-section between the first end 42 and the second end 44 with each of the cross-sections defining an interior 48, as shown in FIGS. 7-9A, 10, and 11. Said differently, the plurality of walls 40 is configured to define the cross-section. As shown in FIGS. 10 and 11, the plurality of walls 40 is typically further defined as four walls 40 arranged to define a rectangular cross-section. It is to be appreciated that the plurality of walls 40 may be any number of walls 40 arranged to define any configuration of the cross-section, including but not limited to three walls 40 configured to define a triangular cross-section.

The cross-section refers to a profile of the frame members 38 as viewed along a longitudinal axis L of the frame members 38. Each cross-section is capable of varying between the first and second ends 42, 44. Variations in the cross-sections typically refers to variations of a length of at least one of the plurality of walls 40 and/or a variation in the shape of the plurality walls 40 as viewed along the longitudinal axis L. It is to be appreciated that the cross-section may vary in any particular way. As a non-limiting example of a variation in the cross-section, the first frame member 38*a* may have an arcuate configuration, as shown in FIGS. 7-9A. When the first frame member 38*a* is manufactured having the arcuate configuration, a plurality of folds 50 may form along one of the plurality of walls 40, which is closest to a center of curvature, which defines the arcuate configuration. The formation of the plurality of folds 50 is a common result of the act of bending a metallic material. The plurality of folds 50 changes the cross-section of the first frame member 38*a* between the first and second ends 42, 44, as illustrated by comparison of FIGS. 10 and 11. Alternatively, the frame member 38 may have changes in the cross-section between the first and second ends 42, 44 for the purpose of production. It is to be appreciated that the cross-sections may vary for any design or aesthetic purpose.

As shown in FIGS. 2 and 15, each of the frame members 38 is positioned sequentially end to end. Furthermore, the first end 42 of the first frame member 38*a* is adjacent the second end 44 of the second frame member 38*b*. It is to be appreciated that the first end 42 of the first frame member 38*a* may be adjacent the first end 42 of the second frame member 38*b*. Likewise, the second end 44 of the first frame member 38*a* is adjacent the second end 44 of the second frame member 38*b*. It is to be appreciated that the term "first end" and the term "second end" are interchangeable and may refer to either end of the frame members 38.

The frame assembly 20 is typically a barrier positioned within the opening 22 for preventing movement of an object through the opening 22. More specifically, the frame assembly 20 further comprises an article 52 coupled to and supported by the first and second frame members 38*a*, 38*b*. As shown in FIG. 9B, the frame members 38 each may have a lip 54 to which the article 52 is coupled. The article 52 coupled to and supported by the first and second frame members 38*a*, 38*b* fills the opening 22 and is a barrier preventing movement of an object through the opening 22. It is to be appreciated that the object may be anything capable of moving through the opening 22 such as an animate object, such as a person or an animal, or an inanimate object, such as a piece of furniture or a child's toy.

When the structure 24 is the fireplace 26 as shown in FIG. 1, the frame assembly 20 is typically positioned within the opening 22 of the fireplace 26. If the fireplace 26 has the glass panel, the glass panel is positioned between the firebox and the frame assembly 20 with the frame assembly 20 spaced from the glass panel. Furthermore, when the structure 24 is the fireplace 26 as shown in FIG. 1, the article 52 is further defined as a screen 56, as shown in FIGS. 1, 2 and 15. The screen 56 allows passage of heat from the flammable fuel out of the firebox through the opening 22. Furthermore, air flows through the screen 56 allowing the screen 56 to dissipate heat better than, for example, the glass panel. As such, the screen 56 has a lower temperature than the flammable fuel and/or the glass panel. Therefore, if the screen 56 is contacted by the object, the object is less likely to incur heat-related damage than if the object contacted the flammable fuel or the glass panel. It is to be appreciated does not have to be the screen 56 and does not have to have heat dissipation properties as described above. Therefore, the article 52 may be any article for coupling to the frame members 38, including glass.

When the structure 24 is the building, the frame assembly 20 including the article 52 prevents passage of the object through the opening 22 into and out of the building. Here, the object may include dirt, insects, animals, persons, etc. It is to be appreciated that the frame assembly 20 may have any configuration for preventing the passage of the object through the opening 22.

As shown in FIGS. 3-5 and 12-14, the frame assembly 20 further comprises a cornerlock 58 for use with the frame assembly 20, which supports the article 52. The cornerlock 58 extends into each of the first and second frame members 38*a*, 38*b* to couple together the first and second frame members 38*a*, 38*b*, as shown in FIGS. 6-9A. As described above, typically the first end 42 of the first frame member 38*a* is adjacent the second end 44 of the second frame member 38*b*. As such, the cornerlock 58 extends into the first end 42 of the first frame member 38*a* and into the second end 44 of the second frame member 38*b*. As described above, the terms "first end" and "second end" are interchangeable on the frame members 38. As also described above, the terms "first frame member" and "second frame member" may refer to any of the frame members 38. As such, the cornerlock 58 may couple any two adjacent frame members 38. Furthermore, the cornerlock 58 may be a plurality of cornerlocks 58 each coupling adjacent frame members 38. It is to be appreciated that the cornerlock 58 may be any number of cornerlocks 58 coupling any of the frame members 38. For the sake of simplicity, only one cornerlock 58 is referred to below coupling the first and second frame members 38*a*, 38*b*. It is to be appreciated that the description below may be applied to any cornerlock 58 and to any frame member 38.

The cornerlock 58 comprises a first body member 60 configured to mate with the interior 48 of the first frame member 38*a*, and a second body member 62 configured to mate with the interior 48 of the second frame member 38*b*. The first body member 60 may be cantilevered with the first frame member 38*a* and the second body member 62 may be cantilevered with the second frame member 38*b*. Said differently, the first body member 60 may extend into a portion of the interior 48 of the first frame member 38*a* and the second body member 62 may extend into a portion of the interior 48 of the second frame member 38*b*.

Each of the body members 60, 62 has a hinge end 64, 65 and a distal end 66, 67 spaced from the hinge end 64, 65. The first and second body members 60, 62 are rotatably coupled together at the hinge ends 64, 65.

Figure 20:
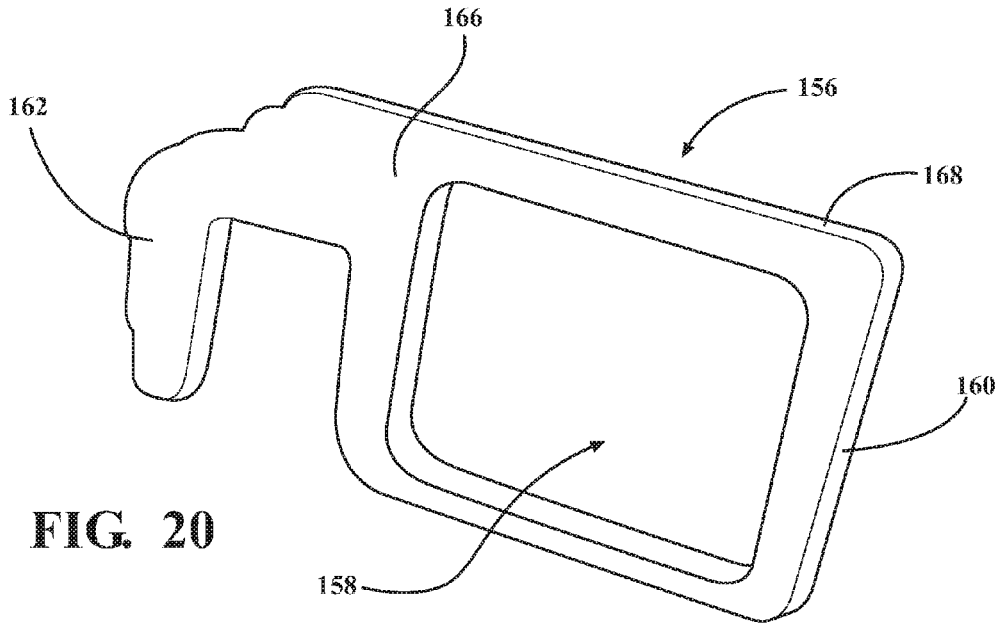
FIG. 20 is a perspective view of the collar.
Figure 21:
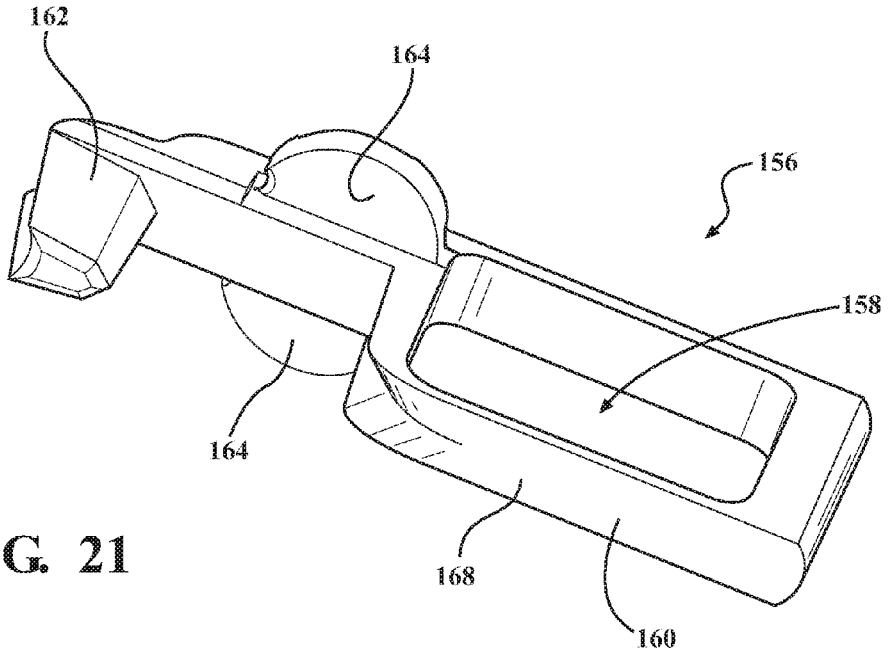
FIG. 21 is a perspective view of the collar having a pair of bosses.

As shown in FIGS. 20 and 21, the cornerlock 58 further includes a collar 156 defining a hole 158. At least one of the first and second body members 60, 62 extends through the hole 158 such that the collar 156 is disposed at the hinge end 64, 65 for engaging each of the first and second frame members 38*a*, 38*b*, as shown in FIGS. 6-9A, 23, and 24.

To enable rotation between the first and second body members 60, 62, one of the first and second body members 60, 62 may have a post 70 at the hinge end 64, 65 and another one of the first and second body members 60, 62 may define a cavity 72 at the hinge end 64, 65 as shown in FIGS. 4, 5, 12, and 13. Typically, the second body member 62 has the post 70 and the first body member 60 defines the cavity 72. However, it is to be appreciated that the opposite may be true, i.e., the first body member 60 may have the post 70 and the second body member 62 may define the cavity 72.

Each of the first and second body members 60, 62 may extend along an axis A. Furthermore, each of the first and second body members 60, 62 may have a primary portion 74, 75 extending along the axis A. The post 70 extends transverse to the axis A of the one of the first and second body members 60, 62. More specifically, as shown in the Figures, the post 70 extends perpendicular to the axis A. However, it is to be appreciated that the post 70 may extend at any angle transverse to the axis A.

The post 70 extends through the cavity 72 to rotatably couple together the first and second body members 60, 62. Said differently, the first and second body members 60, 62 rotate about their respective hinge ends 64, 65, which are coupled to one another.

Figure 4:
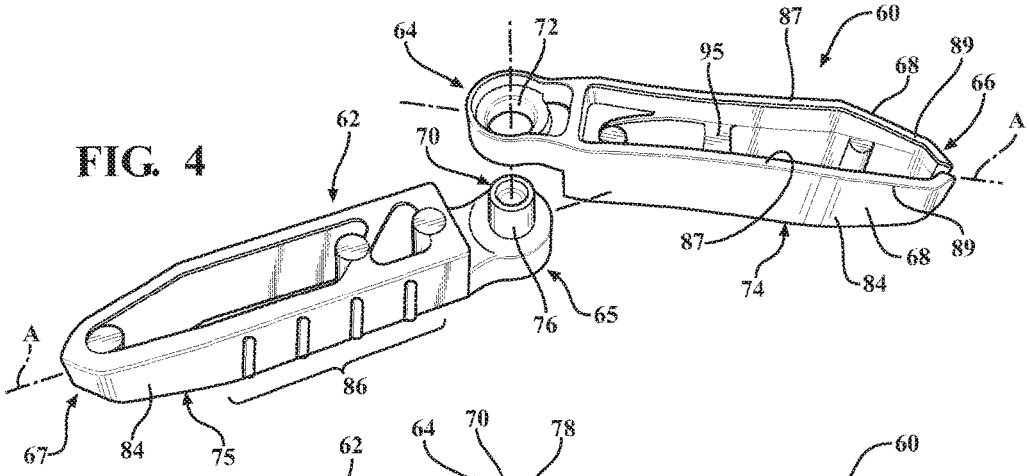
FIG. 4 is perspective view of the first and second body members of the cornerlock prior to coupling together.
Figure 5:
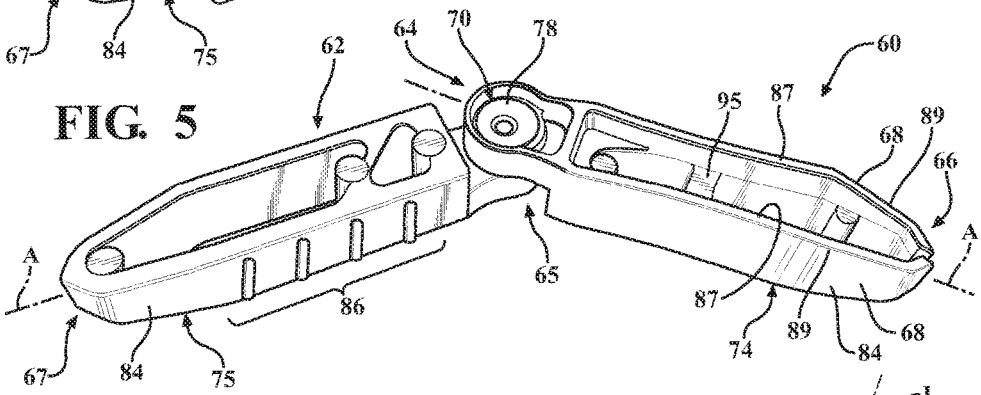
FIG. 5 is a perspective view of the first and second body members of the cornerlock rotatably coupled together.

As shown in FIGS. 4 and 5, the post 70 may have a shaft 76 and a shoulder 78 mounted to the shaft 76 and spaced from the primary portion 74, 75. The shaft 76 is disposed in the cavity 72 of the other one of the first and second body members 60, 62. The shoulder 78 and the primary portion 74, 75 of the one of the first and second body members 60, 62 abuts the primary portion 74, 75 of the other one of the first and second body members 60, 62 to rotatably couple together the first and second body members 60, 62. Specifically, as shown in the Figures, the second body member 62 has the shaft 76 and the shoulder 78 and the first body member 60 defines the cavity 72; however, it is to be appreciated that the opposite may be true, i.e., the first body member 60 may have the shaft 76 and the shoulder 78 and the second body member 62 may define the cavity 72. The shoulder 78 is typically formed by orbital riveting after the shaft 76 is disposed in the cavity 72, but may be formed by any suitable manufacturing method. The primary portion 74 of the first body member 60 is positioned between the shoulder 78 and the primary portion 75 of the second body member 62 such that the first body member 60 does not slide off of the shaft 76 of the second body member 62.

Figure 12:
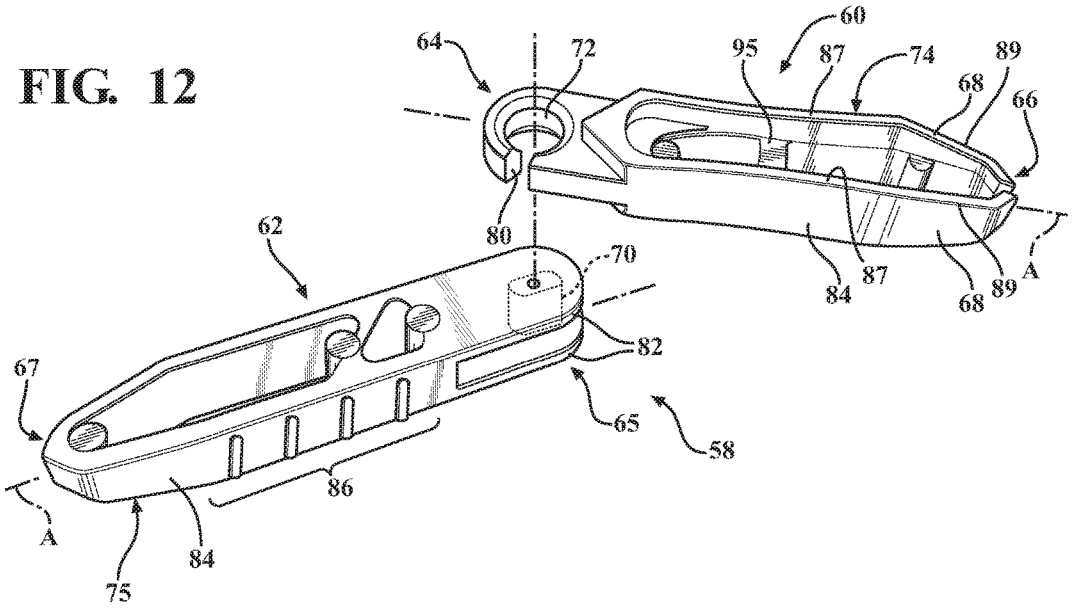
FIG. 12 is perspective view of the first body member defining a cavity and an opening and the second body members having a post with the first and second body members spaced from one another prior to coupling together.
Figure 13:
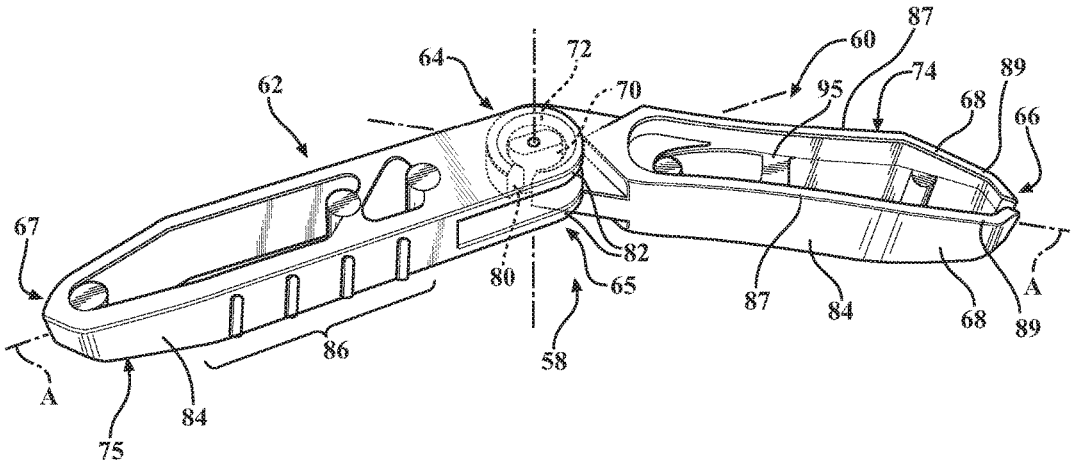
FIG. 13 is a perspective view of the first body member defining the cavity and the second body member having the post extending through the cavity to couple together the first and second body members.

Alternatively, as shown in FIGS. 12 and 13, the other one of the first and second body members 60, 62 may define an opening 80 in communication with the cavity 72 to facilitate insertion of the post 70 into the cavity 72. Said differently, the opening 80 is transverse to the cavity 72 with the opening 80 providing entry into the cavity 72. As shown in the figures, the first body member 60 defines the opening 80. The opening 80 is transverse to a longitudinal axis of the cavity 72 through the first body member 60. Furthermore, the opening 80 is transverse to the axis A. The opening 80 may be anywhere along the first body member 60 for facilitating insertion of the post 70 into the cavity 72.

The one of the first and second body members 60, 62 which has the post 70 (typically, the second body member 62 as shown in the figures and described as such going forward) may have a pair of side members 82 extending from the primary portion 75 along the axis A spaced from and substantially parallel to each other at the hinge end 65, as shown in FIGS. 12 and 13. The side members 82 are positioned on opposing sides of the first body member 60 such that the hinge end 64 of the first body member 60 is between the side members 82. The post 70 extends between and is mounted to each of the pair of side members 82. The post 70 has a rectangular configuration. Said differently, the post 70 has a pair of long sides spaced from one another and a pair of short sides extending between the long sides. The rectangular configuration allows insertion of the post 70 through the opening 80 into the cavity 72 when one of the short sides faces the opening 80. When in the cavity 72 and rotated, the long sides are too large to exit the cavity 72, which retains the post 70 in the cavity 72. The primary portion 74 of the first body member 60 is positioned between the side members 82 of the second body member 62 such that the first body member 60 may not slide off of the post 70 of the second body member 62. It is to be appreciated that the first and second body members 60, 62 may be rotatably coupled to each other in any suitable way.

Figure 3:
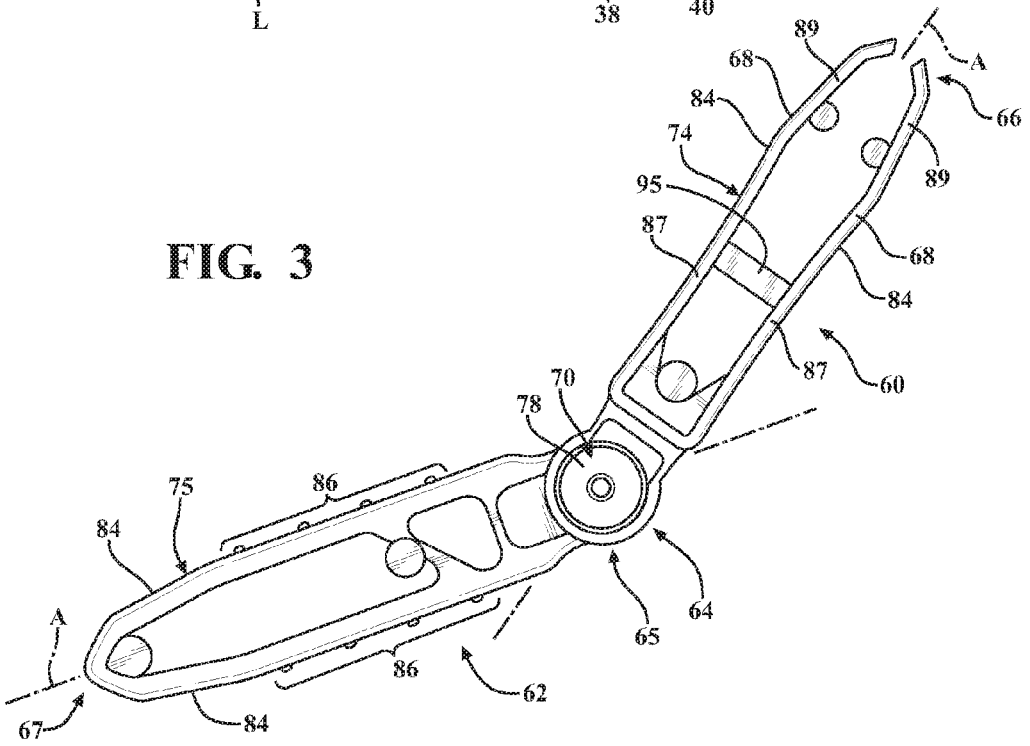
FIG. 3 is an elevational view of first and second body members of the cornerlock, rotatably coupled together.

As shown in FIG. 3, the primary portion 74, 75 of the each of the first and second body members 60, 62 may have a pair of engagement surfaces 84 opposing one another for engaging the walls 40 within the interiors 48 of the respective first and second frame members 38*a*, 38*b*. As described above, the second body member 62 has the primary portion 75 extending along the axis A. At least one rib 86 extends from the primary portion 75 transverse to the axis A for engaging the second frame member 38*b* within the interior 48 of the second frame member 38*b*, as shown in FIGS. 7-9A. More specifically, one of the pair of engagement surfaces 84 defines the at least one rib 86. The at least one rib 86 may be further defined as a plurality of ribs 86 defined on each of the pair of engagement surfaces 84 of the primary portion 75 of the second body member 62. Although not shown in the Figures, it is to be appreciated that the at least one rib 86 may extend from the primary portion 75 of the second body member 62 and/or the primary portion 74 of the first body member 60.

As shown in FIGS. 2 and 7-9A, the second frame member 38*b* has a substantially linear configuration with the cross-section of the second frame member 38*b* generally consistent between the first and second ends 42, 44. The primary portion 75 has a width between the pair of engagement surfaces 84 that is substantially equal to the cross-section of the second frame member 38*b* for facilitating engagement of the primary portion 75 with the second frame member 38*b* and retention of the second body member 62 in the interior 48 of the second frame member 38*b*.

As described above, the cross-section of the frame members 38 may vary between the first and second ends 42, 44. As described above, the frame members 38 may have the arcuate configuration which may vary the cross-section between the first and second ends 42, 44. Such an arcuate configuration is shown with the first frame member 38*a* in FIGS. 7-9A. Although the first frame member 38*a* is shown with the arcuate configuration in the Figures, it is to be appreciated that the second frame member 38*b* may have the arcuate configuration. Said differently, any of the frame members 38 may have the arcuate configuration. Similarly, any of the frame members 38 may have the substantially linear configuration described above. Furthermore, the cross-section of any of the frame members 38 may vary for any reason, such as variations occurring through manufacturing and/or by specific design.

As shown in FIGS. 3, 14, 17, and 19, the first body member 60 may have at least one arm 68 extending from its respective hinge end 64 to the distal end 66. The at least one arm 68 may be deflectable about the hinge end 64 to bias against and engage the first frame member 38*a* within the interior 48 of the first frame member 38*a* and self-configure the first body member 60 to the cross-section of the first frame member 38*a*. Said differently, the at least one arm 68 may be configured to deflect and the hinge end 64 of the first body member 60 is rigid and configured to not deflect as the at least one arm 68 deflects. The at least one arm 68 engages at least one of the walls 40 of the first frame member 38*a* within the interior 48 and deflects about the hinge end 64 toward the axis A, as shown between FIGS. 7 and 8. The at least one arm 68 may deflect about the hinge end 64 toward and away from the axis A. The deflection of the at least one arm 68 corresponds with the engagement of the at least one arm 68 with the at least one of the walls 40, which facilitates the bias exerted by the at least one arm 68 against the first frame member 38*a*. The bias exerted by the at least one arm against the first frame member 38*a* increases a frictional force between the first body member 60 and the first frame member 38*a* that retains the first body member 60 in the interior 48 of the first frame member 38*a*. Furthermore, the deflection of the at least one arm 68 allows the first body member 60 to self-configure to the cross-section of the first frame member 38*a*. As described above, the cross-section may vary, for example, when the first frame member 38*a* has the arcuate configuration where the plurality of folds 50 extends into the interior 48. When the first frame member 38*a* has the arcuate configuration, the at least one arm 68 may deflect to engage the first frame member 38*a* and self-configure the first body member 60 to the cross-section of the first frame member 38*a* along the arcuate configuration. To compensate for the extension of the plurality of folds 50 into the interior 48, the at least one arm 68 deflects toward the axis A with the at least one arm 68 engaging the plurality of folds 50 of the first frame member 38*a*.

The at least one arm 68 of the first body member 60 may be further defined as, and is typically, a pair of arms 68 extending from and independently deflectable about the hinge end 64. As shown between FIGS. 7 and 8, each of the pair of arms 68 biases against and engages the first frame member 38*a* within the interior 48 and self-configures the first body member 60 to the cross-section of the first frame member 38*a*. Said differently, the pair of arms 68 engages the walls 40 of the first frame member 38*a* within the interior 48. The pair of arms 68 engages the walls 40 at at least two points of contact. Typically, the pair of arms 68 each engage one of the walls 40 of the first frame member 38*a* such that the pair of arms 68 engage two of the walls 40; however, it is to be appreciated that the pair of arms 68 may engage any number of the walls 40. Each of the pair of arms 68 may independently deflect about the hinge end 64 toward and away from the axis A. Typically, the pair of arms 68 engages the first frame member 38*a* and deflects toward the axis A. The deflection of each of the pair of arms 68 corresponds with the engagement of each of the pair of arms 68 with the walls 40 of the first frame member 38*a*. The engagement of one of the pair of arms 68 with the first frame member 38*a* may be different than the engagement of another one of the pair of arms 68. As such, the pair of arms 68 may have different degrees of the deflection depending on the configuration of the walls 40 that the each of the pair of arms 68 engages. Each of the pair of arms 68 bias against the first frame member 38*a* which increases the frictional force between the first body member 60 and the first frame member 38*a* and retains the first body member 60 in the interior 48 of the first frame member 38*a*. Furthermore, the independent deflection of the pair of arms 68 allows the first body member 60 to self-configure to the cross-section of the first frame member 38*a*, as described in greater detail above.

Typically, the pair of arms 68 extends spaced from and substantially parallel to each other from the hinge end 64 to the distal end 66 with each of the pair of arms 68 independently deflectable toward and away from each other. The pair of arms 68 applies opposing bias to the first frame member 38*a* within the interior 48 and self-configures the first body member 60 to the cross-section of the first frame member 38*a*. Said differently, the pair of arms 68 engages the walls 40 at at least two points of contact opposing one another. Typically, the pair of arms 68 each engages opposing walls 40 of the first frame member 38*a*. As such, the deflection of the pair of arms 68 corresponds with the engagement of the at least one arm 68 with at least one of the walls 40, which facilitates the opposing bias exerted by the pair of arms 68 against the opposing walls 40 of the first frame member 38*a* further increasing the frictional force between the first body member 60 and the first frame member 38*a* that retains the first body member 60 in the interior 48 of the first frame member 38*a*. It is to be appreciated that the pair of arms 68 may engage any of the walls 40 while applying opposing bias to the first frame member 38*a*.

Figure 8:
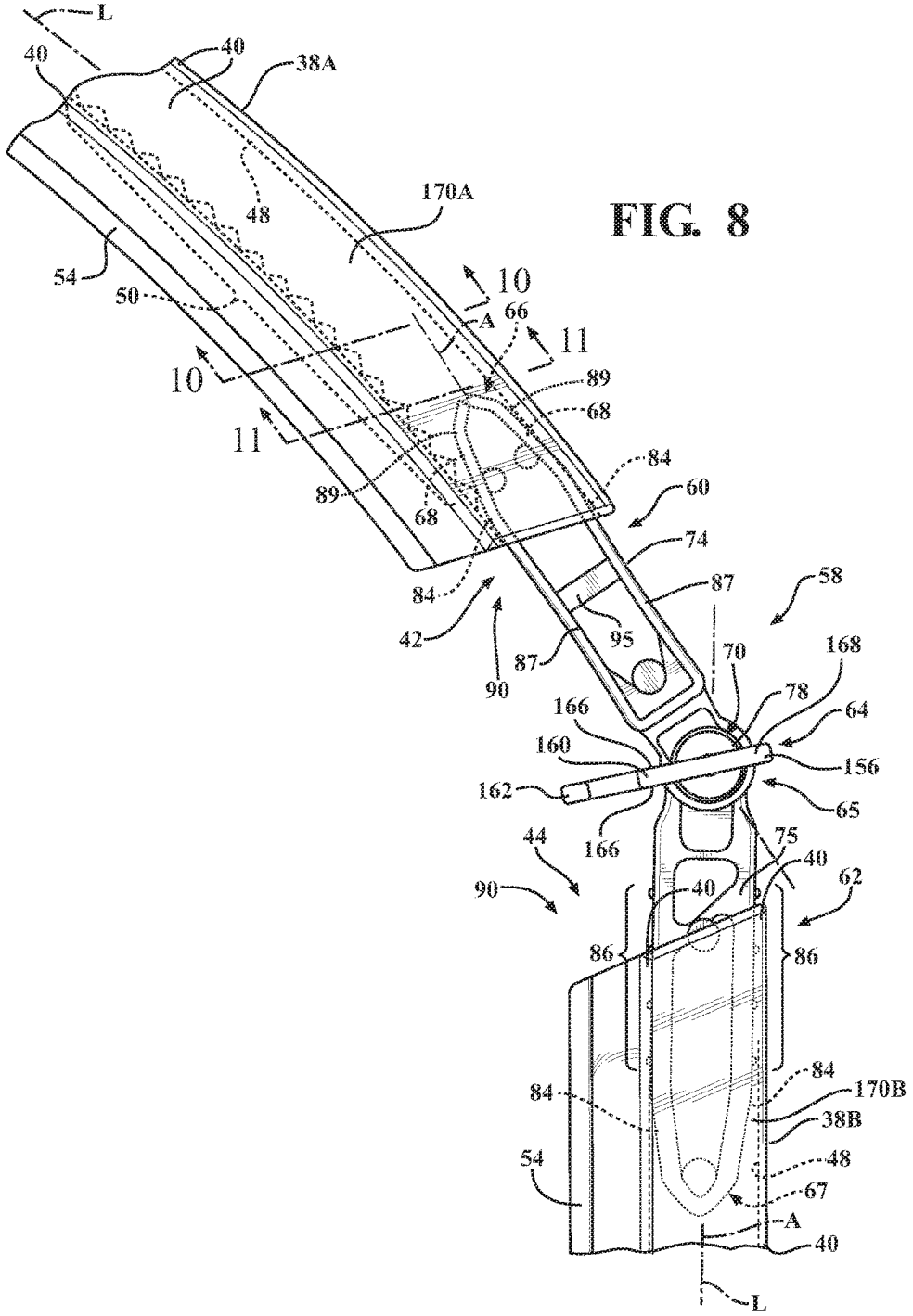
FIG. 8 is an elevational view of the first and second body members of the cornerlock partially inserted into the interiors of the first and second frame members and the first body member having a pair of arms engaging walls of the first frame member and deflecting.

When the first frame member 38*a* has the arcuate configuration, the pair of arms 68 independently deflects to engage the first frame member 38*a* and self-configure the first body member 60 to the cross-section of the first frame member 38*a* along the arcuate configuration. To compensate for the extension of the plurality of folds 50 into the interior 48, at least one of the pair of arms 68 deflect toward the axis A with the at least one of the pair of arms 68 engaging the plurality of folds 50 of the first frame member 38*a*, as shown in FIG. 8.

Figure 7:
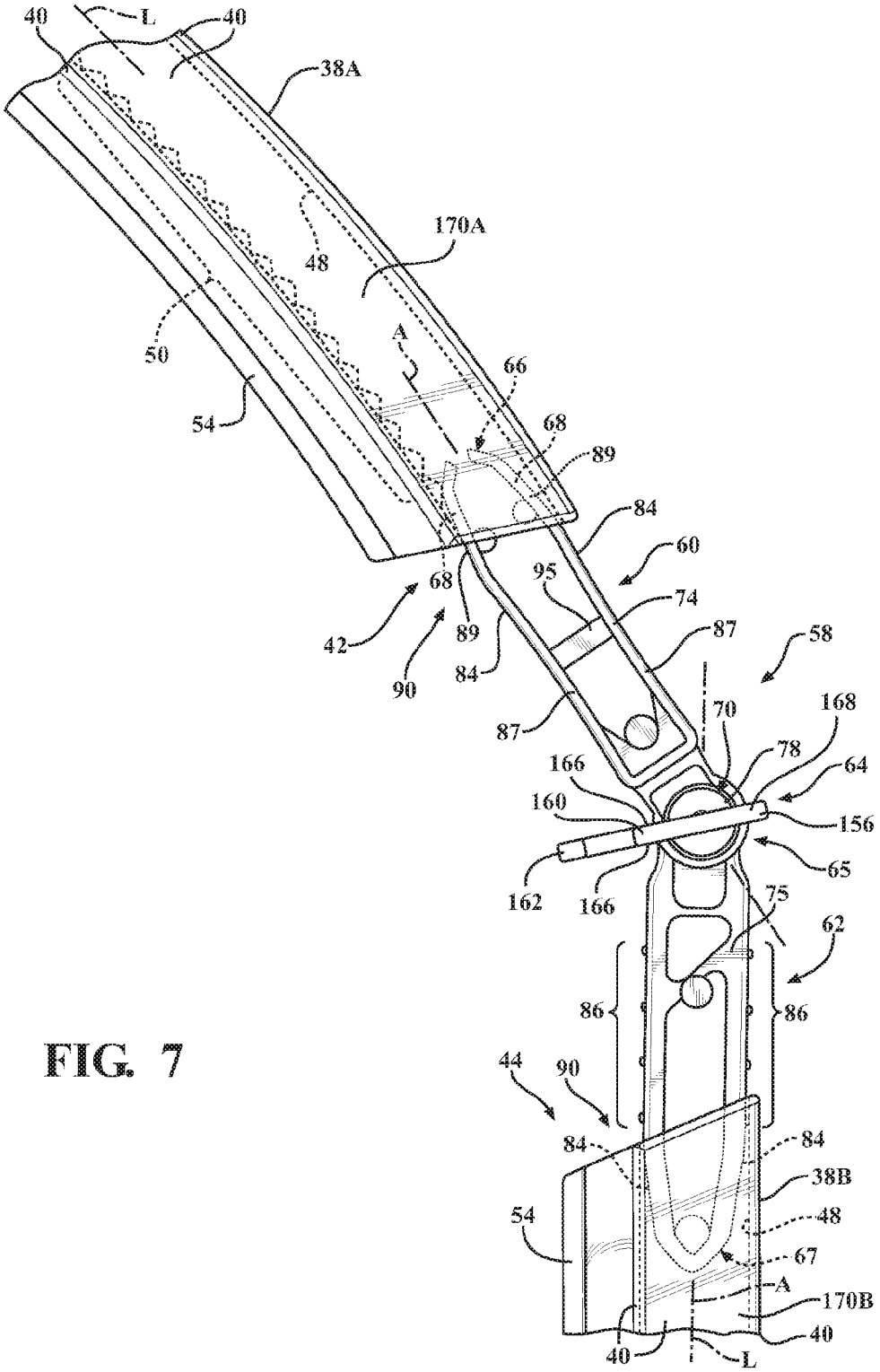
FIG. 7 is an elevational view of the first and second body members of the cornerlock partially inserted into the interiors of the first and second frame members.

Each of the pair of arms 68 may be tapered toward each other at the distal end 66 for facilitating insertion of the first body member 60 into the interior 48 of the first frame member 38*a*. Said differently, the pair of arms 68 extend closer to each other and the axis A further toward the distal end 66. More specifically, each of the pair of arms 68 may have a first portion 87 adjacent the hinge end 64 and a second portion 89 adjacent the distal end 66 with the first portions 87 of the pair of arms 68 substantially parallel to one another for engaging the walls 40 of the first frame member 38*a*. The second portions 89 of the pair of arms 68 may angle toward each other at the distal end 66. Furthermore, each of the second portions 89 may be comprised of multiple sections such that second portions 89 progressively angle further toward each other toward the distal end 66. The tapering of the pair of arms 68 facilitates an increase in bias and deflection of the arms 68 as the first frame member 38*a* engages and moves along the arms 68. For example, as shown in FIG. 7, one of the plurality of folds 50 engages one of the pair of arms 68 along the engagement surface 84 toward the distal end 66 as the first body member 60 is inserted into the interior 48 of the first frame member 38*a*. As shown in FIG. 8, as the first body member 60 is inserted further into the interior 48 of the first frame member 38*a*, the one of the plurality of folds 50 moves along the taper and engages the engagement surface 84. The movement of the one of the plurality of folds 50 along the taper causes the one of the pair of arms 68 to deflect toward the axis A. As such, the taper of the pair of arms 68 toward each other eases the insertion of the first body member 60 into the interior 48 of the first frame member 38*a* by gradually increasing the engagement of the first frame member 38*a* with the arms 68 and the corresponding the deflection of and bias exerted by the arms 68.

The first body member 60 may have a brace 95 positioned between the hinge end 64 and the distal end 66 and extending between and coupled to each of the pair of arms 68. More specifically, the brace 95 extends between and is coupled to the first portion of each of the pair of arms 68, spaced from the second portion 89 of each of the pair of arms 68. The brace 95 further defines the deflection of each of the pair of arms 68 about said hinge end 64. More specifically, the brace 95 localizes the deflection of each of the pair of arms 68 about the hinge end 64 to substantially toward the distal end 66. In doing so, the amount of deflection of the arms 68 about the hinge end 64 may be designed according to the position of the brace 95 relative the hinge end 64. More specifically, the closer the brace 95 is to the hinge end 64, the greater the amount of deflection of each of the pair of arms 68.

Figure 16:
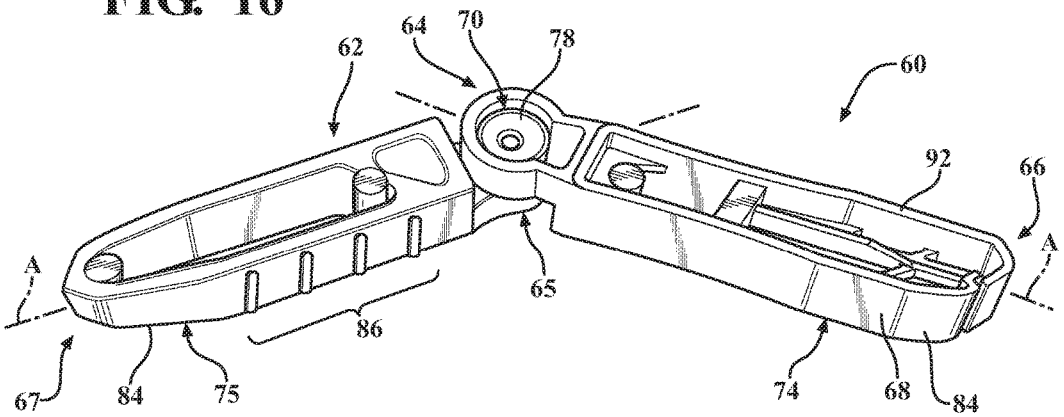
FIG. 16 is a perspective view of the first and second body members rotatably coupled together with the first body member having the at least one arm and a leg.
Figure 17:
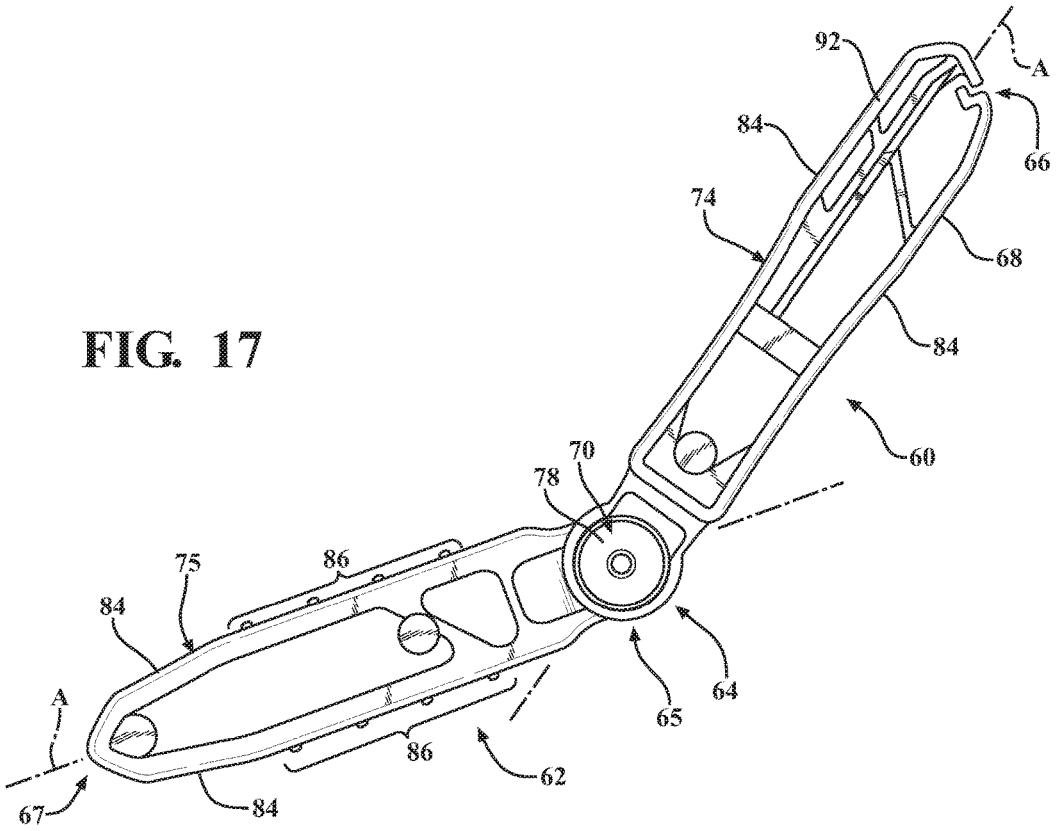
FIG. 17 is an elevational view of the first and second body members rotatably coupled together with the first body member having the at least one arm and the leg.

It is to be appreciated that the at least one arm 68 of the first body member 60 may be a single arm. As one non-limiting example, the first body member 60 may further have a leg 92 extending from the hinge end 64 to the distal end 66, as shown in FIGS. 16 and 17. The leg 92 is typically resistant to deflection. The at least one arm 68 is further defined as a single arm 68 spaced from the leg 92 and deflectable about the hinge end 64. Typically, the leg 92 and the single arm 68 extend from the hinge end 64 to the distal end 66 in a substantially parallel configuration. It is to be appreciated that the leg 92 and the single arm 68 may extend from the hinge end 64 to the distal end 66 at any type of angle and in any configuration. The single arm 68 biases against and engages the first frame member 38*a* while simultaneously engaging the leg 92 with the first frame member 38*a* within the interior 48 of the first frame member 38*a*, self-configuring the first body member 60 to the cross-section of the first frame member 38*a*. Said differently, the bias of the single arm 68 against one of the walls 40 of the first frame member 38*a* moves the leg 92 (which is resistant to deflection) and the primary portion 74 away from the wall 40 and causes the leg 92 to engage another one of the walls 40. As such, the single arm 68 and the leg 92 engage the walls 40 of the first frame member 38*a* at at least two points of contact, further increasing the frictional force between the first body member 60 and the first frame member 38*a* which retains the first body member 60 in the interior 48 of the first frame member 38*a*.

As another non-limiting example, the at least one arm 68 may be further defined as a single arm 68 having a first section 94 and a second section 96 each extending between a first end 98, 102 and a second end 100, 104 as shown in FIGS. 18 and 19. The first section 94 extends in a first angular direction from the first end 98, adjacent the hinge end 64, to the second end 100. More specifically, the first end 98 of the first section 94 is typically coupled to the primary portion 74 of the first body member 60. The second section 96 extends in a second angular direction from the first end 102, adjacent the second end 100 of the first section 94, to the second end 104 of the second section 96 such that the first and second sections 94, 96 define an angle X1 and have a zig-zag configuration for engaging one of the plurality of walls 40 of the first frame member 38*a* at the second end 100 of the first section 94 and engaging another one of the plurality of walls 40 of the first frame member 38*a* at the second end 104 of the second section 96. As such, the second ends 100, 104 of the first and second sections 94, 96 of the single arm 68 engage the walls 40 of the first frame member 38*a* at at least two points of contact, further increasing the frictional force between the first body member 60 and the first frame member 38*a* which retains the first body member 60 in the interior 48 of the first frame member 38*a* while only requiring the single arm 68.

The angle X1 between the first and second sections 94, 96 is non-linear to facilitate the zig-zag configuration which causes the single arm 68 to engage at least two walls 40 of the first frame member 38*a* at at least two points of contact, further increasing the frictional force between the first body member 60 and the first frame member 38*a* which retains the first body member 60 in the interior 48 of the first frame member 38*a* while only requiring the single arm 68. Furthermore, the angle X1 between the first and second section 94, 96 is typically 90 degrees. It is to be appreciated that the angle X1 may be any suitable angle to engage at least two walls 40 of the first frame member 38*a*. The single arm 68 may have any number of sections. For example, as shown in FIGS. 18 and 19, the single arm 68 may have third, fourth, and fifth sections 106, 108, 110 each having a first end 112, 116, 120 and a second end 114, 118, 122. The third section 106 extends in a third angular direction from the first end 112, adjacent the second end 104 of the second section 96, to the second end 114. The fourth section 108 extends in a fourth angular direction from the first end 116, adjacent the second end 114 of the third section 106, to the second end 118. The fifth section 110 extends in a fifth angular direction from the first end 120, adjacent the second end 118 of the fourth section 108, to the second end 122. As such, the angle X1 between the first and second sections 94, 96 may be further defined as a first angle X1. Likewise, the second and third sections 96, 106 may define a second angle X2, the third and fourth sections 106, 108 may define a third angle X3, and the fourth and fifth sections 108, 110 may define a fourth angle X4.

The first, third, and fifth angular directions typically are substantially the same angular direction. Likewise, the second and fourth angular directions typically are substantially the same angular direction. As such, first angle X1 and the third angle X3 are equal and the second angle X2 and the fourth angle X4 are equal. As described above, typically the first angle X1 is 90 degrees. If the first angle X1 is 90 degrees, if the first, third, and fifth angular directions are substantially the same angular direction, and if the second and fourth angular directions are substantially the same angular direction; then each of the first, second, third, and fourth angles X1, X2, X3, X4 are 90 degrees.

Furthermore, all of the angular directions are typically positioned on the same plane. As such, the second ends 100, 114, 122 of the first, third and fifth sections 94, 106, 110 typically engage the same one of the plurality of walls 40 of the first frame member 38*a* while the second ends 104, 118 of the second and fourth sections 96, 108 typically engage the same one of the plurality of walls 40 other than the wall 40 engaged by the first, third, and fifth sections 94, 106, 110.

The zig-zag configuration promotes flexing of the single arm 68 into engagement with more than one of the walls 40 of the first frame member 38*a*. Specifically, the sections 94, 96, 106, 108, 110 flex relative to one another to self-configure the single arm 68 to the cross-section of the first frame member 38*a* having two points of contact with the first frame member 38*a*. In particular, the zig-zag configuration self-configures the single arm 68 to the varying cross-section of the first frame member 38*a* caused by the first frame member 38*a* having the arcuate configuration. It is to be appreciated that the cross-section of the first frame member 38*a* may vary for any reason.

It is to be appreciated that the at least one arm 68 may be any number of arms 68 deflectable about the hinge end 64 to bias against and engage the first frame member 38*a* within the interior 48 of the first frame member 38*a* and self-configure the first body member 60 to the cross-section of the first frame member 38*a*.

The first frame member 38*a* may have a substantially linear configuration as shown in FIG. 15. Furthermore, the cross-section of the first frame member 38*a* having the substantially linear configuration may vary between the first and second ends 42, 44. It is to be appreciated that the first frame member 38*a* may be shaped in any particular configuration and may have any particular cross-section, both constant and variable, between the first and second ends 42, 44. Furthermore, it is to be appreciated that the first body member 60 may be inserted into the interior 48 of the first frame member 38*a* at any one of the first and second ends 42, 44, the interior 48 of the second frame member 38*b* at any one of the first and second ends 42, 44, or the interior 48 of any of the frame members 38 at any one of the first and second ends 42, 44.

Furthermore, the second body member 62 may have at least one arm 88 extending from the hinge end 65 to the distal end 67, as shown in FIG. 14, with the at least one arm 88 deflectable about the hinge end 65 for biasing against and engaging the second frame member 38*b* within the interior 48 of the second frame member 38*b* and self-configuring the second body member 62 to the cross-section of the second frame member 38*b*. Said differently, the at least one arm 88 is configured to deflect and the hinge end 65 of the second body member 62 is rigid and configured to not deflect as the at least one arm 88 deflects. Although not illustrated, the at least one arm 88 engages at least one of the walls 40 of the second frame member 38*b* within the interior 48 and deflects about the hinge end 65 toward the axis A, similar to the deflection of the at least one arm 68 of the first body member 60 described above and illustrated between FIGS. 7 and 8. Hereinafter, descriptions of the engagement of the at least one arm 88 of the second body member 62 with the second frame member 38*b* shall refer to in-part or whole to FIGS. 7-9A with the intent that the engagement of the at least one arm 68 of the first body member 60 with the first frame member 38*a* shall teach and illustrate the engagement of the at least one arm 88 of the second body member 62 with the second frame member 38*b*.

The at least one arm 88 may deflect about the hinge end 65 toward and away from the axis A, as illustrated between FIGS. 7 and 8. The deflection of the at least one arm 88 corresponds with the engagement of the at least one arm 88 with the at least one of the walls 40, which facilitates the bias exerted by the at least one arm 88 against the second frame member 38*b*. The bias exerted by the at least one arm 88 against the second frame member 38*b* increases a frictional force between the second body member 62 and the second frame member 38*b* that retains the second body member 62 in the interior 48 of the second frame member 38*b*. Furthermore, the deflection of the at least one arm 88 allows the second body member 62 to self-configure to the cross-section of the second frame member 38*b*. As described above, the cross-section of the frame members 38 may vary. For example, the second frame member 38*b* may have an arcuate configuration, similar to the arcuate configuration described above for the first frame member 38*a*, with the second frame member 38*b* having the plurality of folds 50 extending into the interior 48. When the second frame member 38*b* has the arcuate configuration the at least one arm 88 deflects to engage the second frame member 38*b* and self-configure the second body member 62 to the cross-section of the second frame member 38*b* along the arcuate configuration. To compensate for the extension of the plurality of folds 50 into the interior 48, the at least one arm 88 deflects toward the axis A with the at least one arm 88 engaging the plurality of folds 50 of the second frame member 38*b*.

The at least one arm 88 of the second body member 62 may be further defined as, and is typically, a pair of arms 88 extending from and independently deflectable about the hinge end 65, as shown in FIG. 14. As illustrated between FIGS. 7 and 8, each of the pair of arms 88 biases against and engages the second frame member 38*b* within the interior 48 and self-configures the second body member 62 to the cross-section of the second frame member 38*b*. Said differently, the pair of arms 88 engages the walls 40 of the second frame member 38*b* within the interior 48. The pair of arms 88 engages the walls 40 at at least two points of contact. Typically, the pair of arms 88 each engage one of the walls 40 of the second frame member 38*b* such that the pair of arms 88 engage two of the walls 40; however, it is to be appreciated that the pair of arms 88 may engage any number of the walls 40. Each of the pair of arms 88 may independently deflect about the hinge end 65 toward and away from the axis A. Typically, the pair of arms 88 engages the second frame member 38*b* and deflects toward the axis A. The deflection of each of the pair of arms 88 corresponds with the engagement of each of the pair of arms 88 with the walls 40 of the second frame member 38*b*. The engagement of one of the pair of arms 88 with the second frame member 38*b* may be different than the engagement of another one of the pair of arms 88. As such, the pair of arms 88 may have different degrees of the deflection depending on the configuration of the walls 40 that the each of the pair of arms 88 engages. Each of the pair of arms 88 bias against the second frame member 38*b* which increases the frictional force between the second body member 62 and the second frame member 38*b* and retains the second body member 62 in the interior 48 of the second frame member 38*b*. Furthermore, the independent deflection of the pair of arms 88 allows the second body member 62 to self-configure to the cross-section of the second frame member 38*b*, as described in greater detail above.

Typically, as shown in FIG. 14, the pair of arms 88 extends spaced from and substantially parallel to each other from the hinge end 65 to the distal end 67 with each of the pair of arms 88 independently deflectable toward and away from each other. As illustrated between FIGS. 7 and 8, the pair of arms 88 applies opposing bias to the second frame member 38*b* within the interior 48 and self-configures the second body member 62 to the cross-section of the second frame member 38*b*. Said differently, the pair of arms 88 engages the walls 40 at at least two points of contact opposing one another. Typically, the pair of arms 88 each engages opposing walls 40 of the second frame member 38*b*. As such, the deflection of the pair of arms 88 corresponds with the engagement of the at least one arm 88 with the at least one of the walls 40 and facilitates the opposing bias exerted by the pair of arms 88 against the opposing walls 40 of the second frame member 38*b* which further increases the frictional force between the second body member 62 and the second frame member 38*b* and retains the second body member 62 in the interior 48 of the second frame member 38*b*. It is to be appreciated that the pair of arms 88 may engage any of the walls 40 while applying opposing bias to the second frame member 38*b*.

When the second frame member 38*b* has the arcuate configuration, the pair of arms 88 independently deflects to engage the second frame member 38*b* and self-configure the second body member 62 to the cross-section of the second frame member 38*b* along the arcuate configuration. To compensate for the extension of the plurality of folds 50 into the interior 48, at least one of the pair of arms 88 deflect toward the axis A with the at least one of the pair of arms 88 engaging the plurality of folds 50 of the second frame member 38*b*, as illustrated in FIG. 8.

As shown in FIG. 14, each of the pair of arms 88 may be tapered toward each other at the distal end 67 for facilitating insertion of the second body member 62 into the interior 48 of the second frame member 38*b*. Said differently, the pair of arms 88 extend closer to each other and the axis A the closer the arms 88 extend toward the distal end 67. More specifically, each of the pair of arms 88 may have a first portion 91 adjacent the hinge end 65 and a second portion 89 adjacent the distal end 67 with the first portions 91 of the pair of arms 88 substantially parallel to one another for engaging the walls 40 of the second frame member 38*b*. The second portions 93 of the pair of arms 88 may angle toward each other at the distal end 67. Furthermore, each of the second portions 93 may be comprised of multiple sections such that second portions 93 progressively angle further toward each other toward the distal end 67. The tapering of the pair of arms 88 facilitate an increase in bias and deflection of the arm(s) 88 as the second frame member 38*b* engages and moves along the arm(s) 88 as described above and shown in FIGS. 7-8 referring to the engagement of the first body member 60 and the first frame member 38*a* along the taper.

The second body member 62 may have a brace 97 positioned between the hinge end 65 and the distal end 67 and extending between and coupled to each of the pair of arms 88. More specifically, the brace 97 extends between and is coupled to the first portion 91 of each of the pair of arms 88, spaced from the second portion 93 of each of the pair of arms 88. The brace 97 further defines the deflection of each of the pair of arms 88 about said hinge end 65. More specifically, the brace 97 localizes the deflection of each of the pair of arms 88 about the hinge end 65 to substantially toward the distal end 67. In doing so, the amount of deflection of the arms 88 about the hinge end 65 may be designed according to the position brace 97 relative the hinge end 65. More specifically, the closer the brace 97 is to the hinge end 65, the greater the amount of deflection of each of the pair of arms 88.

As described above and shown in FIG. 14, the cornerlock 58 may have the first and second body members 60, 62 each with the at least one arm 68, 88. It is to be appreciated that the cornerlock 58 may be configured such that only the second body member 62 has the at least one arm 88.

It is to be appreciated that the at least one arm 88 of the second body member 62 may be a single arm. Although not explicitly shown in the Figures, it is to be appreciated that the second body member 62 may have a leg 124 extending from the hinge end 65 to the distal end 67 and the at least one arm 88 may be further defined as a single arm spaced from the leg and deflectable about the hinge end 65, similar to the leg 92 and the single arm 68 described above for the first body member 60 and shown in FIGS. 16 and 17.

Also, although not explicitly shown in the Figures, it is to be appreciated that the at least one arm 88 of the second body member may be further defined as a single arm having a first section and a second section (and typically further having third, fourth, and fifth sections) similar to the at least one arm 68 having the first and second sections 94, 96 in the zig-zag configuration described above for the first body member 60 and shown in FIGS. 18 and 19.

It is to be appreciated that the at least one arm 88 may be any number of arms 88 deflectable about the hinge end 65 to bias against and engage the second frame member 38*b* within the interior 48 of the second frame member 38*b* and self-configure the second body member 62 to the cross-section of the second frame member 38*b*.

It is to be appreciated that the second frame member 38*b* may shaped in any particular configuration and may have any particular cross-section, both constant and variable, between the first and second ends 42, 44. Additionally, it is to be appreciated that the second body member 62 may be inserted into the interior 48 of the second frame member 38*b* at any one of the first and second ends 42, 44, the interior 48 of the first frame member 38*a* at any one of the first and second ends 42, 44, or the interior 48 of any of the frame members 38 at any one of the first and second ends 42, 44.

As shown in FIGS. 3, 17, 19, and 23, the second body member 62 may have a unitary design such that the second body member 62 extends as a single unit from the hinge end 65 to the distal end 67 (i.e., the second body member does not have a pair of arms). Similarly, the first body member 60 may have a unitary design similar to the unitary design of the second body member 62 shown in FIG. 23.

Although the cornerlock 58 has been described and shown herein as having a hinged design (i.e., the first and second body members 60, 62 rotatably coupled together at the hinged ends 64, 65), one having skill in the art will appreciate that the cornerlock 58 may have a rigid design where the first and second body members 60, 62 are fixed to one another (i.e., do not rotate) at the hinge ends 64, 65.

Typically, the first and second body members 60, 62 are comprised of a metallic material. More typically, the first and second body members 60, 62 are comprised of a die-cast zinc alloy. It is to be appreciated that the first and second body members 60, 62 may be comprised of other metallic materials, such as aluminum and steel. Furthermore, the first and second body members 60, 62 may be comprised other materials such as a high-temperature plastic, standard plastic, or composite. One having skill in the art will appreciate that the first and second body members 60, 62 may be comprised of any suitable material. It is to be appreciated that varying the material of the first and second body members 60, 62 may alter the ability of the at least one arm 68 to deflect. As such, the composition of the first and second body members 60, 62 has a relationship with the bias exerted by the at least one arm 68.

Figure 6:
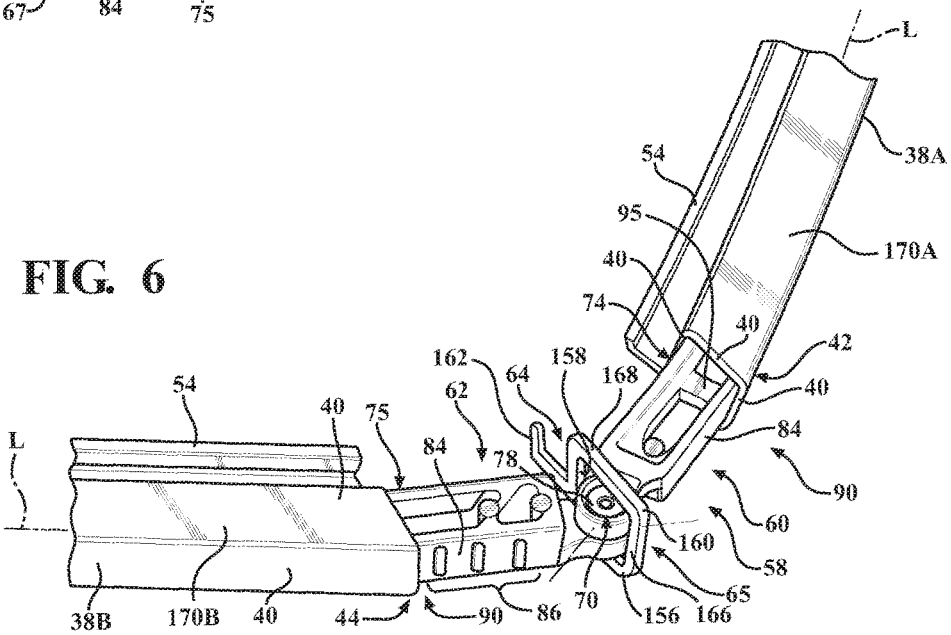
FIG. 6 is a perspective view of a first frame member and a second frame member each defining an interior with the cornerlock partially inserted into the interiors.
Figure 22:
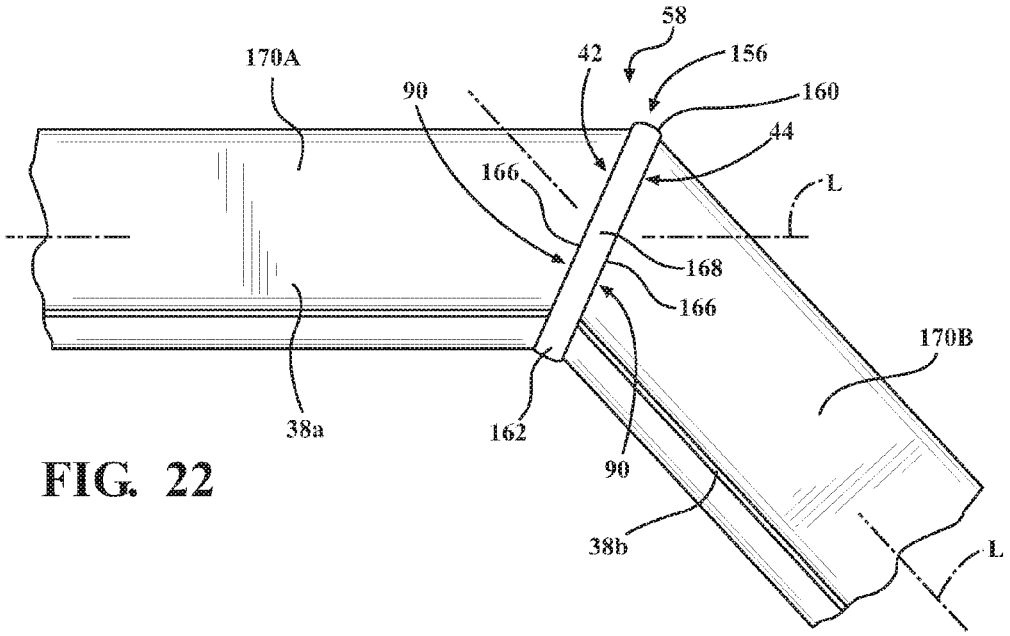
FIG. 22 is an elevational view of the first and second frame members abutting the collar shown in FIG. 20.
Figure 23:
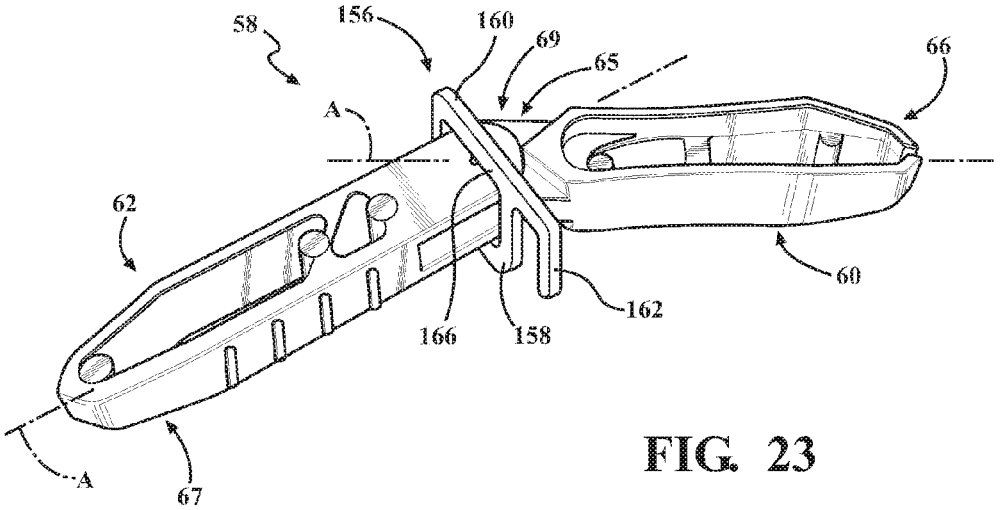
FIG. 23 is a perspective view of the collar disposed about the hinge ends of the first and second body members.
Figure 24:
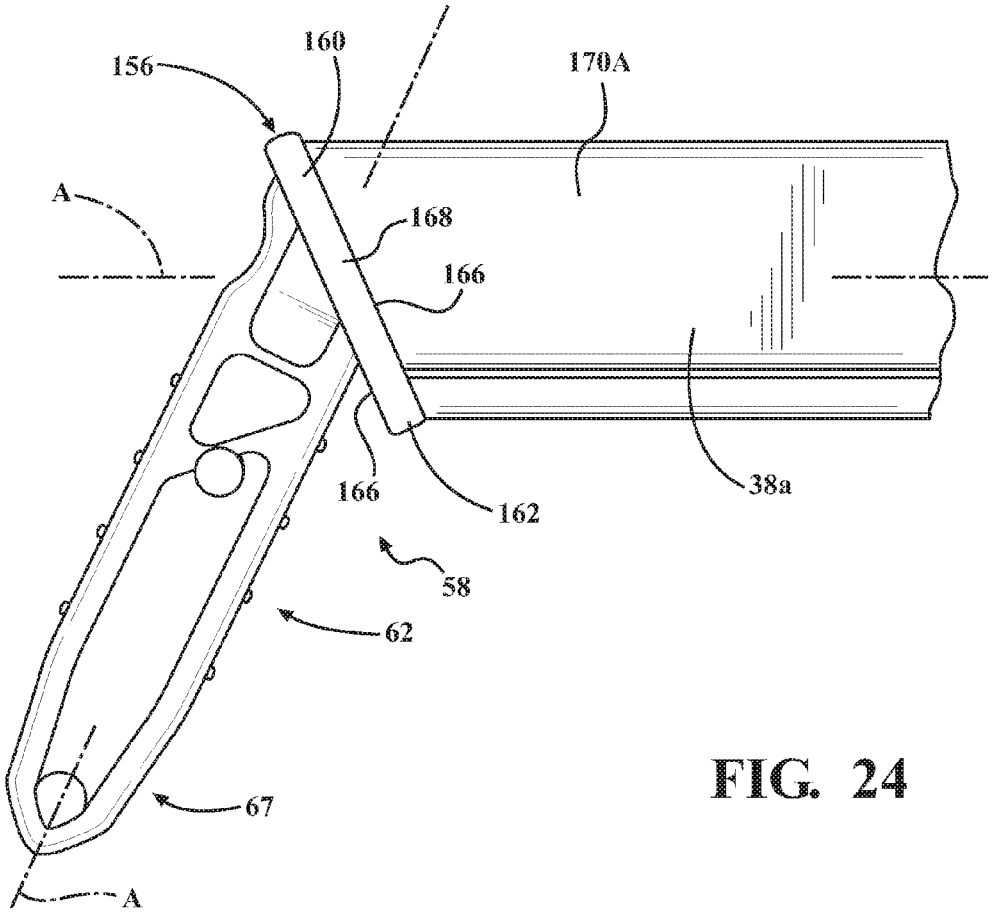
FIG. 24 is a perspective view of the collar disposed about the hinge ends of the first and second body members, with first body member partially disposed in the interior of the first frame member.

As described above and shown in FIGS. 20 and 21, the cornerlock 58 further includes the collar 156 defining the hole 158. At least one of the first and second body members 60, 62 extends through the hole 158 such that the collar 156 is disposed substantially at the hinge end 64, 65 for engaging each of the first and second frame members 38*a*, 38*b*, as shown in FIGS. 6-9A and 22-24. As shown in FIG. 23, the hole 158 may be defined along the axes A of the first and second body members 60, 62. Furthermore, the collar 156 may be disposed along the longitudinal axes L of the first and second frame members 38*a*, 38*b*, as shown in FIGS. 6 and 24.

As shown in FIGS. 20 and 21, the collar 156 may have a body portion 160 with the body portion 160 defining the hole 158. The body portion 160 may have a substantially rectangular configuration. The collar 156 may have a projection 162 extending from the body portion 160 in a substantially L-shape configuration. The substantially L-shape configuration of the projection 162 is similar to the lip 54 of the frame members 38 for coupling the article 52 thereto. Moreover, the body portion 160 and the projection 162 of the collar 156 may have a cross-section that is substantially similar a cross-section of the frame members 38, as shown in FIGS. 6-9A, 24, and 25. The collar 156 may extend along a plane transverse to the axis A to abut one of the first and second ends 42, 44 of each of the first and second frame members 38*a*, 38*b*. Furthermore, the collar 156 may have a consistent thickness about the axis A. One having skill in the art will appreciate that the collar 156 may extend along any suitable plane and may have a varying thickness about the axis A.

Figure 9A:
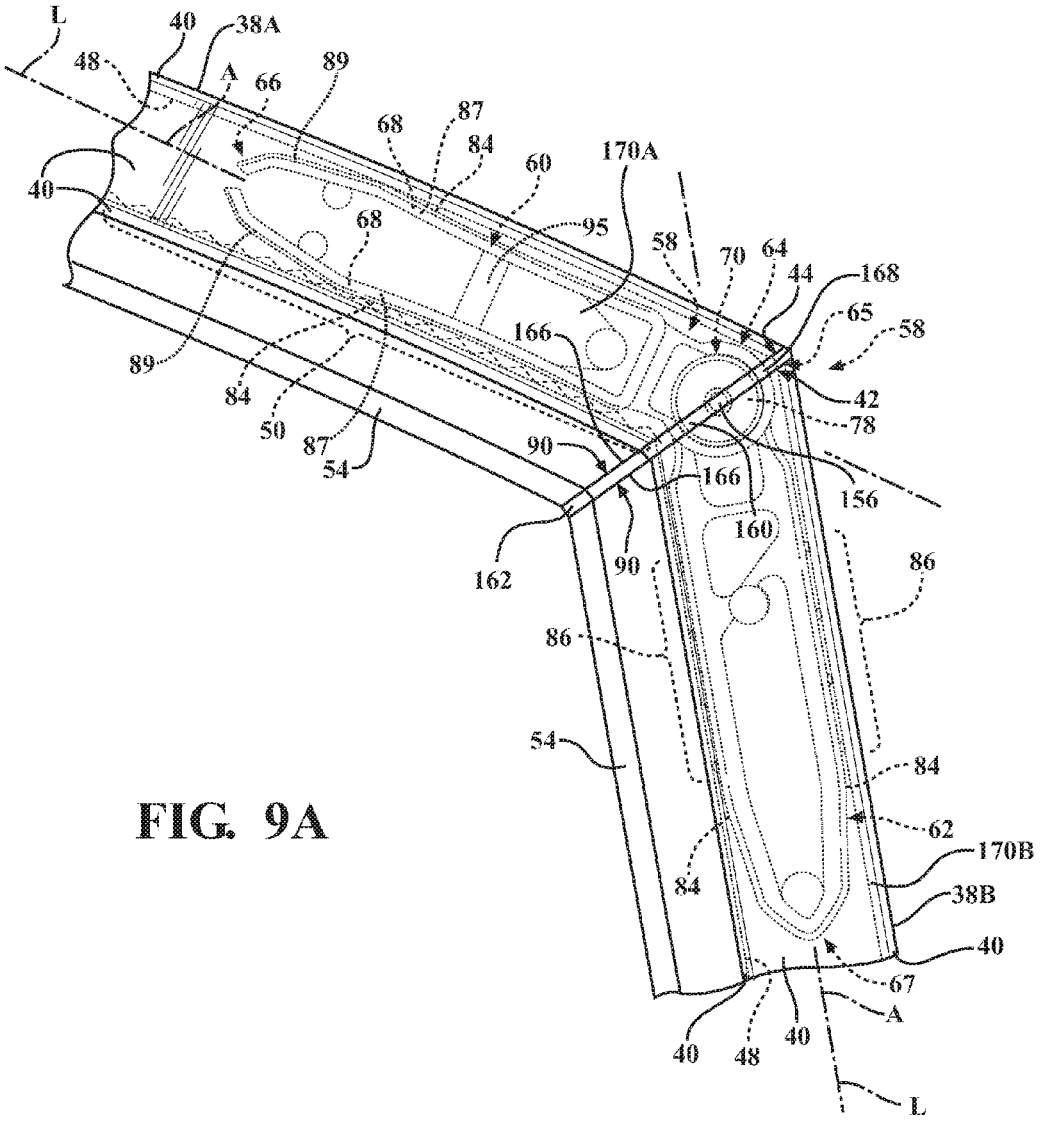
FIG. 9A is an elevational view of the first and second body members of the cornerlock fully inserted into the interiors of the first and second frame members and the first and second frame members having mitered ends abutting the collar.
Figure 9B:
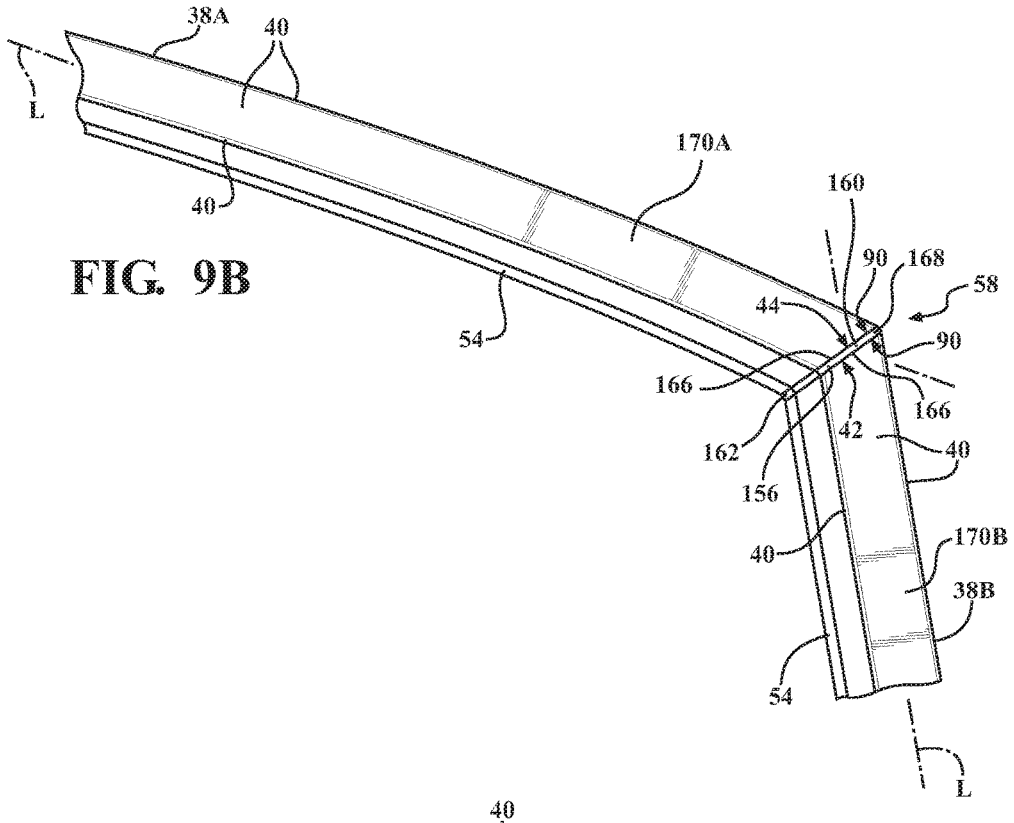
FIG. 9B is an elevational view of the first and second frame members abutting the collar at the mitered ends.

Each of the first and second frame members 38*a*, 38*b* may have a mitered end 90, as shown in FIGS. 9A and 9B. The mitered ends 90 are configured to define an angular configuration of the first and second frame members 38*a*, 38*b*. The cornerlock 58 extends into the interiors 48 of the first and second frame members 38*a*, 38*b* at the mitered ends 90. The collar 156 may be disposed in the middle between the first and second body members 60, 62. One having skill in the art will appreciate that the collar 156 may be disposed at substantially the hinge end 64, 65 of either of the first and second body members 60, 62. Each of the first and second frame members 38*a*, 38*b* may abut the collar 156 at the mitered ends 90 in the angular configuration, as shown in FIGS. 9A, 9B, and 22. The angular configuration of the first and second frame members 38*a*, 38*b* and the corresponding angle of the mitered ends 90 may be any suitable angle. The cornerlock 58 is configured to rotate the first and second body members 60, 62 to correspond with the angular configuration of the first and second frame members 38*a*, 38*b* such that the cornerlock 58 is disposed within a combination of the hole 158 of the collar 156 and the interiors 48 of the first and second frame members 38*a*, 38*b* at the mitered ends 90. More specifically, at least the first end 42 of the first frame member 38*a* and the second end 44 of the second frame member 38*b* are the mitered ends 90 with the first and second frame members 38*a*, 38*b* abutting the collar 156 at the mitered ends 90. It is to be appreciated that the second end 44 of the first frame member 38*a*, the first end 42 of the second frame member 38*b*, and the first and second ends 42, 44 of any other frame member 38 may be the mitered ends 90 with each of the mitered ends 90 configured to abut the collar 156 along with the mitered end 90 of the adjacent frame member 38.

As shown in FIGS. 6, 20, 21, and 23, the hole 158 may have a substantially rectangular configuration corresponding to the cross-sectional configuration of the first and second body members 60, 62 at the hinge ends 64, 65. The substantially rectangular configuration of the hole 158 may correspond to an angle between the axes A of the first and second body members 60, 62. Said differently, the substantially rectangular configuration of the hole 158 may be sized and shaped according to the angle formed between the first and second body members 60, 62, which is defined by the angular configuration of the first and second frame members 38*a*, 38*b* at the mitered ends 90. For example, the hole 158 of the collar 156 may be larger as the angular configuration of the first and second body members 60, 62 (and the first and second frame members 38*a*, 38*b*) become more acute. Said differently, as the angular configuration of the first and second body members 60, 62 become more obtuse (i.e., more linear), the hole 158 may become smaller. Such a relationship occurs because the first and second body members 60, 62 become closer to one another as the angular configuration becomes more acute, which takes up more space within the hole 158. Furthermore, the substantially rectangular configuration of the hole 158 may correspond to the substantially rectangular configuration of the body portion 160. One having skill in the art will appreciate that the hole 158 of the collar 156 may be sized and shaped to any suitable configuration for accepting the first and second body members 60, 62 through the hole 158 in the desired angle, including (but not limited to) square, circular, and semi-circular shapes.

Furthermore, the substantially rectangular configuration of the body portion 160 may be sized and shaped according to the angle formed between the first and second body members 60, 62. Said differently, the width of the body portion 160 between opposing surfaces (one of which substantially faces the projection 162), as well as the thickness of the body portion 160 between the opposing surfaces and the hole 158 may vary according to the angle formed between the first and second body members 60, 62. For example, the width may increase as the angle between the first and second body members 60, 62 becomes more acute (i.e., the width may increase to accommodate the increased distance the outside miter tip to the inside miter intersection of the miter ends 90). Furthermore, the width may decrease as the angle between the first and second body members 60, 62 becomes more obtuse. The thickness of the body portion 160 may vary to accommodate the changes in the substantially rectangular configurations of the hole 158 and the body portion 160. As such, the positioning of the hole 158 within the body portion 160 may vary depending on the desired angle between the first and second body members 60, 62. One having skill in the art will appreciate that the body portion 160 of the collar 156 may be sized and shaped to any suitable configuration according to the cross-section of the first and second frame members 38*a*, 38*b*, including (but not limited to) square, circular, and semi-circular shapes.

The cornerlock 58 may be entirely disposed within a combination of the hole 158 of the collar 156 and the interiors 48 of the first and second frame members 38*a*, 38*b*, as shown in FIG. 9A. More specifically, the first body member 60 extends into the interior 48 of the first frame member 38*a* at the first end 42 substantially up to the hinge end 64 and the second body member 62 extends into the interior 48 of the second frame member 38*b* at the second end 44 substantially up to the hinge end 65, with a portion of hinge ends 64, 65 of the first and second body members 60, 62 disposed in the hole 158 of the collar 156. The collar 156 may define a pair of abutment surfaces 166 facing away from one another for engaging each of the first and second frame members 38*a*, 38*b*. The engagement of the first end 42 of the first frame member 38*a* and the second end 44 of the second frame member 38*b* with the pair of abutment surfaces 166 of the collar 156 along the angular configuration fully encloses the first and second body members 60, 62, as shown in FIG. 9A. As such, when fully assembled, the first and second body members 60, 62 are not visible from an exterior of the frame assembly 20. It is to be appreciated that the first and second body members 60, 62 may be partially disposed within the combination of the hole 158 of the collar 156 and the interiors 48 of the first and second frame members 38*a*, 38*b*.

As shown in FIG. 21, the collar 156 may have at least one boss 164 extending outwardly from at least one of the pair of abutment surfaces 166 for engaging at least one of the first and second frame members 38*a*, 38*b*. Furthermore, the at least one boss 164 may extend along at least one of the axes A. As further shown in FIG. 21, the at least one boss 164 may be a pair of bosses 164 each individually extending from the pair of abutment surfaces 166 for independently engaging the first and second frame members 38*a*, 38*b*. Furthermore, the pair of bosses 164 may extend from the projection 162 in opposing directions along the axis A. One having skill in the art will appreciate that the at least one boss 164 may be any number of bosses 164.

The at least one boss 164 may be configured to engage one of the first and second frame members 38*a*, 38*b* in the interior 48. The engagement of the at least one boss 164 locates the collar 156 relative to the one of the first and second frame members 38*a*, 38*b* to properly position the collar 156 in a desired position, which will be better understood below. Furthermore, each of the pair of bosses 164 may be sandwiched between opposing walls 40 of the first and second frame members 38*a*, 38*b* to further couple together the first and second frame members 38*a*, 38*b*.

As shown in FIGS. 6-9B and 22, the collar 156 and the first and second frame members 38*a*, 38*b* may each have an exterior surface 168, 170*a*, 170*b*, with each of the exterior surfaces 168, 170*a*, 170*b*, defining an outer profile. Each of the outer profiles may be substantially equal to one another such that the exterior surfaces 168, 170*a*, 170*b* of the collar 156 and the first and second frame members 38*a*, 38*b* have a uniform appearance. The outer profile of the collar 156 being substantially equal to the outer profile of the first and second frame members 38*a*, 38*b* may refer to the collar 156 extending slightly above the outer profile of the first and second frame members 38*a*, 38*b* (as shown in FIG. 22), the collar 156 being flush with the outer profile of the first and second frame members 38*a*, 38*b*, or the collar being slightly inset relative to the outer profile of the first and second frame members 38*a*, 38*b*. In doing so, the frame assembly 20 has a uniform, aesthetic transition between the first and second frame members 38*a*, 38*b*. The first and second frame members 38*a*, 38*b* may be painted and cut to form the mitered end 90. The abutment of the mitered ends 90 of the first and second frame members 38*a*, 38*b* with the collar 156 prevents exposed burrs formed during the cutting of the mitered ends 90 as well as the exposure of the unpainted cut surfaces of the mitered ends 90, which is aesthetically unappealing. One having skill in the art will appreciate that the frame assembly 20 may be painted after assembly of the cornerlock 58 with the first and second frame members 38*a*, 38*b*. Furthermore, one having skill in the art will appreciate that the frame members 38 may not be painted.

The engagement of the first and second frame members 38*a*, 38*b* with the collar 156 prevents miter mismatch between the first and second frame members 38*a*, 38*b* and helps to define a consistent overall size to the frame assembly 20. More specifically, the size and shape of the collar 156 corresponding with size and shape of the first and second body members 60, 62 and the first and second frame members 38*a*, 38*b* ensures that the correct ends of the first and second frame members 38*a*, 38*b* abut the collar 156 and are coupled together by the first and second body members 60, 62.

As described above, the cornerlock 58 may be a plurality of cornerlocks 58 each coupling adjacent frame members 38. Likewise, the collar 156 may be a plurality of collars 156 each abutting adjacent frame members 38, as shown in FIGS. 1, 2, and 15. It is to be appreciated that the collars 156 may be any number of collars 156 abutting any of the frame members 38.

Typically, the collar 156 is comprised of a metallic material. More typically, the collar 156 is comprised of a die-cast zinc alloy. As such, the collar 156 may be rigid. It is to be appreciated that the collar 156 may be comprised of other metallic materials, such as aluminum and steel. Furthermore, the collar 156 may be comprised other materials such as a high-temperature plastic, standard plastic, or composite. One having skill in the art will appreciate that the collar 156 may be comprised of any suitable material.

Although the collar 156 has been described and shown in the Figures as a separate independent component of the cornerlock 58, one having skill in the art will appreciate that the collar 156 may be an integral component of the cornerlock 58. Said differently, the collar 156 may be fixed to at least one of the first and second body members 60, 62.

The invention has been described in an illustrative manner, and it is to be understood that the terminology which has been used is intended to be in the nature of words of description rather than of limitation. As is now apparent to those skilled in the art, many modifications and variations of the subject invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A cornerlock for use with a frame assembly, with the frame assembly including a first frame member and a second frame member each having a plurality of walls extending between a first end and a second end which is spaced from the first end, with each of the first and second frame members defining an interior, with said cornerlock extending into the interior of each of the first and second frame members, said cornerlock comprising:

a first body member configured to mate with the interior of the first frame member and a second body member configured to mate with the interior of the second frame member, with each of said body members having a hinge end and a distal end spaced from said hinge end, and with said first and second body members rotatably coupled together at said hinge ends; and a collar defining a hole with at least one of said first and second body members extending through said hole such that said collar is disposed at said hinge ends for engaging each of the first and second frame members;

wherein said first body member has a pair of arms each extending from said hinge end to said distal end with said pair of arms independently deflectable about said hinge end; and wherein said second body member extends as a single unit from said hinge end to said distal end.

2. The cornerlock as set forth in claim 1, wherein each of said first and second body members extends along an axis, with said hole of said collar defined along said axes of said first and second body members.

3. The cornerlock as set forth in claim 2, wherein said collar extends along a plane transverse to said axis for abutting one of the first and second ends of each of the first and second frame members.

4. The cornerlock as set forth in claim 1, wherein said collar has a body portion which defines said hole, with said body portion having a substantially rectangular configuration.

5. The cornerlock as set forth in claim 4, wherein said collar has a projection extending from said body portion in a substantially L-shape configuration for coupling an article thereto.

6. The cornerlock as set forth in claim 2, wherein said collar has a consistent thickness about said axes of said first and second body members.

7. The cornerlock as set forth in claim 2, wherein said hole has a substantially rectangular configuration corresponding to the cross-sectional configuration of said first and second body members at the hinge ends.

8. The cornerlock as set forth in claim 7, wherein said substantially rectangular configuration of said hole corresponds to an angle between said axes of said first and second body members.

9. The cornerlock as set forth in claim 1, wherein said collar defines a pair of abutment surfaces facing away from one another for engaging each of the first and second frame members, with said collar having at least one boss extending outwardly from at least one of said pair of abutment surfaces for engaging at least one of the first and second frame members.

10. The cornerlock as set forth in claim 9, wherein said at least one boss is a pair of bosses each individually extending from said pair of abutment surfaces for independently engaging the first and second frame members.

11. The cornerlock as set forth in claim 1, wherein said collar is comprised of a metallic material.

12. A frame assembly for disposing within an opening of a structure, said frame assembly comprising:

a first frame member and a second frame member each having a plurality of walls extending between a first end and a second end which is spaced from said first end, with each of said first and second frame members defining an interior; and a cornerlock extending into said interior of each of said first and second frame members to couple together said first and second frame members, said cornerlock comprising:

a first body member configured to mate with said interior of said first frame member and a second body member configured to mate with said interior of said second frame member, with each of said body members having a hinge end and a distal end spaced from said hinge end, and with said first and second body members rotatably coupled together at said hinge ends; and a collar defining a hole with at least one of said first and second body members extending through said hole such that said collar is disposed at said hinge ends to engage each of said first and second frame members;

wherein said first body member has a pair of arms each extending from said hinge end to said distal end with said pair of arms independently deflectable about said hinge end; and wherein said second body member extends as a single unit from said hinge end to said distal end.

13. The frame assembly as set forth in claim 12, wherein each of said first and second frame members has a mitered end configured to define an angular configuration of said first and second frame members, with each of said first and second frame members abutting said collar at said mitered ends in the angular configuration.

14. The frame assembly as set forth in claim 13, wherein each of said first and second body members extends along an axis, with said hole of said collar defined along said axes of said first and second body members.

15. The frame assembly as set forth in claim 14, wherein said hole has a substantially rectangular configuration corresponding to an angle between said axes of said first and second body members, which is defined by the angular configuration of said first and second frame members at said mitered ends.

16. The frame assembly as set forth in claim 12, wherein said cornerlock is entirely disposed within a combination of said hole of said collar and said interiors of said first and second frame members.

17. The frame assembly as set forth in claim 12, wherein said collar and said first and second frame members each have an exterior surface, with each of said exterior surfaces defining an outer profile, and with each of said outer profiles being substantially equal to one another such that said exterior surfaces of said collar and said first and second frame members have a uniform appearance.

* * * * *